US009428353B2

(12) United States Patent
Obara

(10) Patent No.: US 9,428,353 B2
(45) Date of Patent: Aug. 30, 2016

(54) IMAGE FORMING APPARATUS

(71) Applicant: CANON KABUSHIKI KAISHA, Tokyo (JP)

(72) Inventor: Yuichi Obara, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/679,160

(22) Filed: Apr. 6, 2015

(65) Prior Publication Data

US 2015/0293490 A1 Oct. 15, 2015

(30) Foreign Application Priority Data

Apr. 14, 2014 (JP) ..... 2014-082513

(51) Int. Cl.

| | |
|---|---|
| ***B65H 1/00*** | (2006.01) |
| ***B65H 1/26*** | (2006.01) |
| ***G03G 15/00*** | (2006.01) |
| ***B65H 29/12*** | (2006.01) |
| ***B65H 29/14*** | (2006.01) |
| ***B65H 31/02*** | (2006.01) |
| *G03G 21/16* | (2006.01) |

(52) U.S. Cl.

CPC ..... *B65H 1/266* (2013.01); *B65H 29/125* (2013.01); *B65H 29/14* (2013.01); *B65H 31/02* (2013.01); *G03G 15/6502* (2013.01); *B65H 2301/3122* (2013.01); *B65H 2402/40* (2013.01); *B65H 2402/44* (2013.01); *B65H 2402/46* (2013.01); *B65H 2405/114* (2013.01); *B65H 2405/1122* (2013.01); *B65H 2601/24* (2013.01); *B65H 2801/12* (2013.01); *G03G 21/1619* (2013.01)

(58) Field of Classification Search

CPC ..... G03G 21/1619; B65H 2402/40; B65H 2404/44; B65H 2405/112; B65H 2405/1122; B65H 2405/1124; B65H 2405/114; B65H 2601/24; B65H 240/442

See application file for complete search history.

(56) References Cited

U.S. PATENT DOCUMENTS

| | | | | |
|---|---|---|---|---|
| 7,522,856 | B2 * | 4/2009 | Tsujimoto | G03G 21/1619 399/107 |
| 7,783,226 | B2 * | 8/2010 | Tomatsu | G03G 21/1619 399/107 |
| 8,145,094 | B2 * | 3/2012 | Takemoto | G03G 21/16 312/351.4 |
| 8,360,418 | B2 * | 1/2013 | Matsuyama | B65H 1/266 271/162 |
| 8,532,524 | B2 * | 9/2013 | Souda | G03G 21/16 399/107 |
| 8,731,433 | B2 * | 5/2014 | Kondo | G03G 21/1619 399/107 |

(Continued)

FOREIGN PATENT DOCUMENTS

JP 2008-90042 A 4/2008

*Primary Examiner* — Jeremy R Severson

(74) *Attorney, Agent, or Firm* — Fitzpatrick, Cella, Harper & Scinto

(57) ABSTRACT

The image forming apparatus includes a sheet storing unit insertably and pullably attached to the frame unit, an image forming unit, and a frame unit. The frame unit includes two frame members parallel to each other with a predetermined distance therebetween and are connected and fixed to each other. The two frame members respectively include engaged portions. The sheet storing unit includes engaging portions respectively engageable with the engaged portions in a state where the sheet storing unit is inserted in the frame unit. In a state where the engaging portions respectively engage with the engaged portions, the engaging portions that respectively engage with the engaged portions and a portion between the two engaging portions of the sheet storing unit serve as strengthening members to regulate deformation of the two frame members by at least a predetermined amount.

19 Claims, 14 Drawing Sheets

(56) References Cited

U.S. PATENT DOCUMENTS

| | | | | |
|---|---|---|---|---|
| 8,870,182 | B2 | 10/2014 | Ogata et al. | |
| 9,027,920 | B2 | 5/2015 | Sato et al. | |
| 9,122,228 | B2 * | 9/2015 | Souda | G03G 21/1619 399/110 |
| 2008/0003015 | A1 * | 1/2008 | Tomatsu | G03G 21/1619 399/110 |
| 2009/0001657 | A1 * | 1/2009 | Yamaguchi | B65H 1/266 271/164 |
| 2009/0274484 | A1 * | 11/2009 | Takemoto | G03G 21/16 399/107 |
| 2010/0014887 | A1 * | 1/2010 | Tomatsu | G03G 21/1853 399/107 |
| 2011/0052251 | A1 * | 3/2011 | Kondo | G03G 15/6555 399/107 |
| 2011/0102983 | A1 * | 5/2011 | Souda | G03G 21/1619 361/679.01 |
| 2012/0219316 | A1 * | 8/2012 | Souda | G03G 15/161 399/107 |
| 2013/0322945 | A1 * | 12/2013 | Nishimura | G03G 15/6558 399/395 |

* cited by examiner

IMAGE FORMING APPARATUS

BACKGROUND OF THE INVENTION

1. Field of the Invention

The present invention relates to an image forming apparatus that forms an image on a sheet fed from a sheet storing unit, and, more specifically, to the stiffness of a frame member of an image forming apparatus.

2. Description of the Related Art

Up to now, an image forming apparatus (hereinafter, referred to as a main body) of a copying machine, a printer, a fax machine and combined machines of these machines includes a sheet storing unit, an image forming unit, a fixing unit, a sheet feeding unit and a sheet discharging unit. The sheet storing unit has a bundle of sheets placed therein, and the sheets are recording materials such as plain paper. The sheet feeding unit separates and feeds the sheets one by one from the bundle of sheets in the sheet storing unit, and conveys the sheets toward the image forming unit. The image forming unit forms an image on a sheet. In the case where an electrophotography method is applied to the image forming unit, a toner image that is formed on a sheet by the image forming unit is heated and pressurized on the sheet by the fixing unit. A sheet on which an image is recorded is discharged by the sheet discharging unit. Each of these units is fixed to a frame unit that functions as the skeleton structure of the main body directly or with the intermediation of some members. Among these units, the sheet storing unit is a universal cassette attachable and detachable with respect to the main body in many cases, in order to facilitate refilling with a bundle of sheets. The sheet feeding unit is fixed to the main body, and includes a feeder that separates and feeds a sheet from the bundle of sheets on the universal cassette, in many cases. The universal cassette is mainly provided to a lower portion of the main body in many cases.

In general, in order not to impair the image quality of the image forming apparatus, the amount of change in relative position of each of the above-mentioned units is reduced by enhancing the stiffness of the frame member. The frame member normally has one of a box-like shape and a shape equivalent thereto. Mainly with regard to the bottom surface of the main body, for example, Japanese Patent Application Laid-Open No. 2008-90042 discloses a large-size image forming apparatus including a bottom plate that is a substantially plate-like member and entirely covers the bottom surface of the main body. The use of a small member such as a stay and a configuration in which the bottom surface is opened are known for middle-size and small-size image forming apparatuses.

Unfortunately, if the bottom plate is used for the bottom surface of the main body as described above, the size of the main body, particularly, the size thereof in the height direction becomes larger depending on the shape of the bottom plate, in the case of, for example, such a large-size main body as disclosed in Japanese Patent Application Laid-Open No. 2008-90042.

In a configuration known for a small-size main body, any of the image forming unit, the fixing unit and the sheet discharging unit is provided with a function as a reinforcing member for the main body, whereby the bottom plate is omitted. Because the bottom plate is omitted in such a configuration, a cost corresponding to the bottom plate does not occur. Unfortunately, from the perspective of strength, particularly, strength necessary to transport the main body, there is a limit on the distance between the bottom surface and any of the units that is used as the reinforcing member as an alternative to the bottom plate. Hence, the main body that can have such a configuration is limited to a small apparatus. Further, from the perspective of a reduction in environmental load concerning the amount of used material and product weight, a reduction in thickness of plates used to form the frame member is being required. Under the circumstances, when the main body is transported, the frame is highly likely to deform due to palletization of the main body in a packaged state and an impact caused by dropping, and hence omission of the bottom plate is becoming difficult.

A conceivable method for solving this includes using a packaging material that protects the frame member and prevents deformation thereof, only during transportation. However, the size of the packaging material becomes larger for the purpose of protecting the frame member, so that an environmental load increases.

In view of the above, the present invention proposes a sheet stacking apparatus in which: a sheet storing unit serves as a strengthening member for a frame member in the state where the sheet storing unit is inserted in the frame; and strength necessary to, for example, transport a main body of the apparatus is thus secured with a low environmental load and at low costs.

SUMMARY OF THE INVENTION

The sheet stacking apparatus includes a main body, and a stacking unit that is provided so as to be insertable and pullable with respect to the main body. The main body includes a first frame member provided on one side in a direction orthogonal to an insertion and pull direction of the stacking unit; a second frame member provided on another side in the direction orthogonal to the insertion and pull direction of the stacking unit; and a connection portion that connects the first frame member to the second frame member. The stacking unit includes a stacking portion on which a sheet is stacked; and a regulation member that is provided so as to be movable with respect to the stacking portion in the insertion and pull direction of the stacking unit and regulates a position of an end portion of the sheet stacked on the stacking portion. The regulation member regulates so as to prevent at least part of the first frame member and the second frame member from deforming inward in the direction orthogonal to the insertion and pull direction of the stacking unit.

Further provided is an image forming apparatus including: a sheet storing unit that stores a sheet; an image forming unit that forms an image on the sheet fed from the sheet storing unit; and a frame that supports the image forming unit, the sheet storing unit being insertably and pullably attached to the frame. The frame includes two frame members that are arranged parallel to each other with a predetermined distance therebetween and are connected and fixed to each other. The two frame members respectively include engaged portions. The sheet storing unit includes engaging portions that are respectively engageable with the engaged portions in a state where the sheet storing unit is inserted in the frame. In a state where the engaging portions respectively engage with the engaged portions, the engaging portions that respectively engage with the engaged portions and a portion between the two engaging portions of the sheet storing unit serve as strengthening members to regulate deformation of the two frame members by at least a predetermined amount.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

An embodiment of the present invention is described with reference to the drawings. An overall configuration of an image forming apparatus, a configuration of a frame of the image forming apparatus, a configuration of a universal cassette as a sheet storing unit and configurations and actions of engaging portions and engaged portions are described in the stated order. Here, a laser beam printer is taken as an example of the image forming apparatus.

(Overall Configuration of Image Forming Apparatus)

Figure 1:
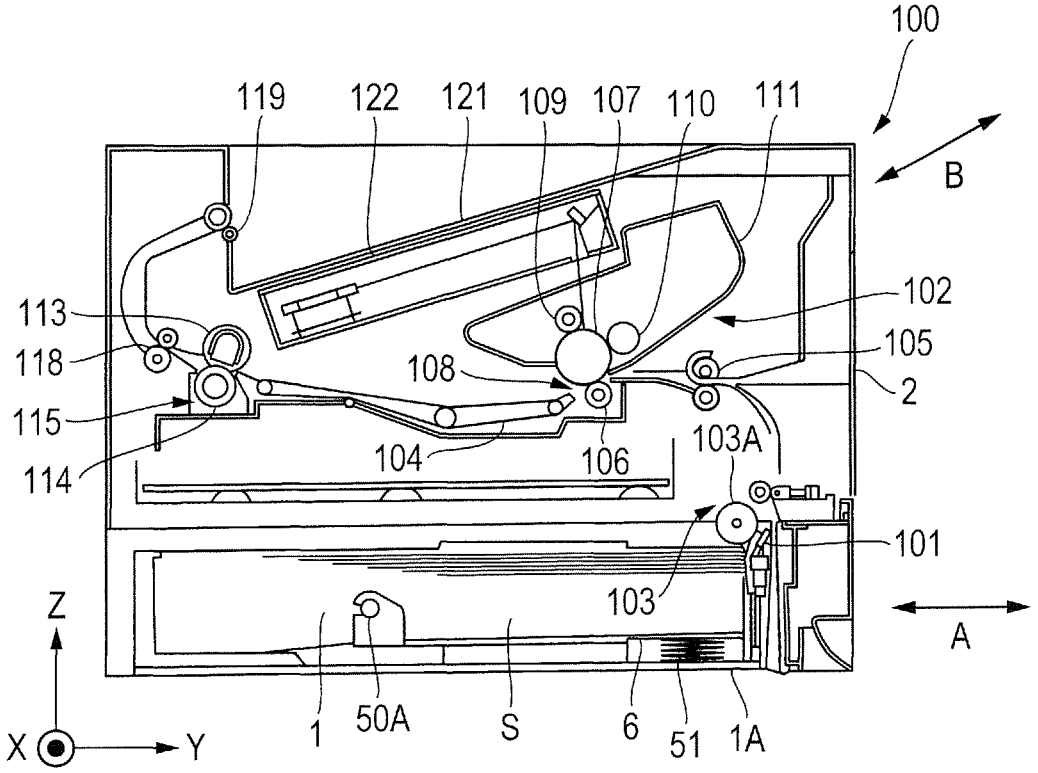
FIG. 1 schematically shows an overall structure of an image forming apparatus is a cross-sectional view, according to an embodiment of the present invention.

An outline of the overall configuration of the image forming apparatus is described with reference to FIG. 1. FIG. 1 is a cross-sectional view illustrating a schematic configuration of a laser beam printer 100 that is an example of the image forming apparatus (sheet stacking apparatus) according to the embodiment of the present invention. A universal cassette (stacking unit) 1 is attached to an apparatus main body (hereinafter, referred to as a main body) 2 of the laser beam printer 100 so as to be insertable and pullable in a direction of an arrow A in FIG. 1. The right direction of the arrow A in FIG. 1 is defined as the front side, the left direction of the arrow A in FIG. 1 is defined as the back side, and the direction orthogonal to the sheet of FIG. 1 is defined as the lateral sides.

In FIG. 1, the main body 2 of the laser beam printer 100 includes: an image forming unit 102 that forms an image according to an electrophotography method; and a sheet feeding apparatus 103 that feeds each sheet S to the image forming unit 102. The image forming unit 102 includes: a photosensitive drum 107 on which a toner image is to be formed; a transfer roller 106 that transfers the toner image formed on the photosensitive drum 107, to the sheet S; a charging roller 109 that uniformly charges the surface of the photosensitive drum; and a developing unit 110. The photosensitive drum 107, the charging roller 109 that uniformly charges the surface of the photosensitive drum, and the developing unit 110 are configured as a process cartridge 111, and are attachable and detachable with respect to the main body 2 in a direction of an arrow B in FIG. 1.

The sheet feeding apparatus 103 is provided above the universal cassette 1 that is a sheet storing unit capable of storing a larger number of the sheets S, and includes a sheet feeding roller 103A that feeds each sheet S stored in the universal cassette 1. The universal cassette 1 includes: a cassette main body (supporting unit) 1A that stores the sheets S; and a middle plate (stacking portion) 6 that is held by the cassette main body 1A so as to be turnable in the top-bottom direction about a shaft 50A as a fulcrum, and is urged by a coil spring 51 toward the sheet feeding roller 103A, the sheets S being stacked on the middle plate 6. The middle plate 6 is pushed up by the coil spring 51 toward the sheet feeding roller 103A, whereby the sheets S stacked on the middle plate 6 are pressed against the sheet feeding roller 103A. The universal cassette 1 further includes a separation unit 101 that separates the sheets S fed by the sheet feeding roller 103A one by one.

Next, an image forming operation of the laser beam printer 100 configured as described above is described. First, based on an image signal from a host computer (not illustrated), the photosensitive drum 107 having a surface that is uniformly charged in advance by the charging roller 109 and rotating in the clockwise direction is irradiated with laser light from a laser scanner 122 provided to the main body 2. As a result, an electrostatic latent image is formed on the surface of the photosensitive drum 107. Then, the electrostatic latent image on the surface of the photosensitive drum 107 is developed by toner on the developing unit 110, and a toner image is formed on the photosensitive drum 107. Meanwhile, the sheet feeding roller 103A starts to rotate at a predetermined timing. In conjunction with this, the middle plate 6 that is urged by the force of the coil spring 51 toward the sheet feeding roller 103A turns upward. As a result, a leading end portion of the sheets S stacked on the middle plate 6 is pressed against the sheet feeding roller 103A with a predetermined force. Here, the sheet feeding roller 103A is controlled so as to rotate in the counterclockwise direction only during sheet feeding, and feeds the sheets S pressed thereagainst by means of frictional force. If a plurality of the sheets S on the middle plate 6 is fed at the same time, only the uppermost sheet S is separated by an action of the separation unit 101, and is conveyed to the downstream side.

The uppermost sheet S thus separated by the separation unit 101 is sent to a registration unit 105 to be subjected to skew correction. Then, the uppermost sheet S is conveyed by the registration unit 105 to a transfer unit 108 including the photosensitive drum 107 and the transfer roller 106. In the transfer unit 108, as described above, the toner image formed on the photosensitive drum 107 is electrically attracted by the transfer roller 106, and is transferred to the sheet S. The sheet S to which the toner image is transferred is then conveyed by a conveyance belt 104 to a fixing unit 115 including a heating unit 113 and a pressurization roller 114, and the sheet S is heated and pressurized by the fixing unit 115, whereby the toner image is fixed on the sheet S. Finally, the sheet S is discharged by an intermediate sheet discharging roller pair 118 and a sheet discharging roller pair 119 onto a sheet discharging tray 121 on the upper surface of the main body.

(Configuration of Frame)

Figure 2A:
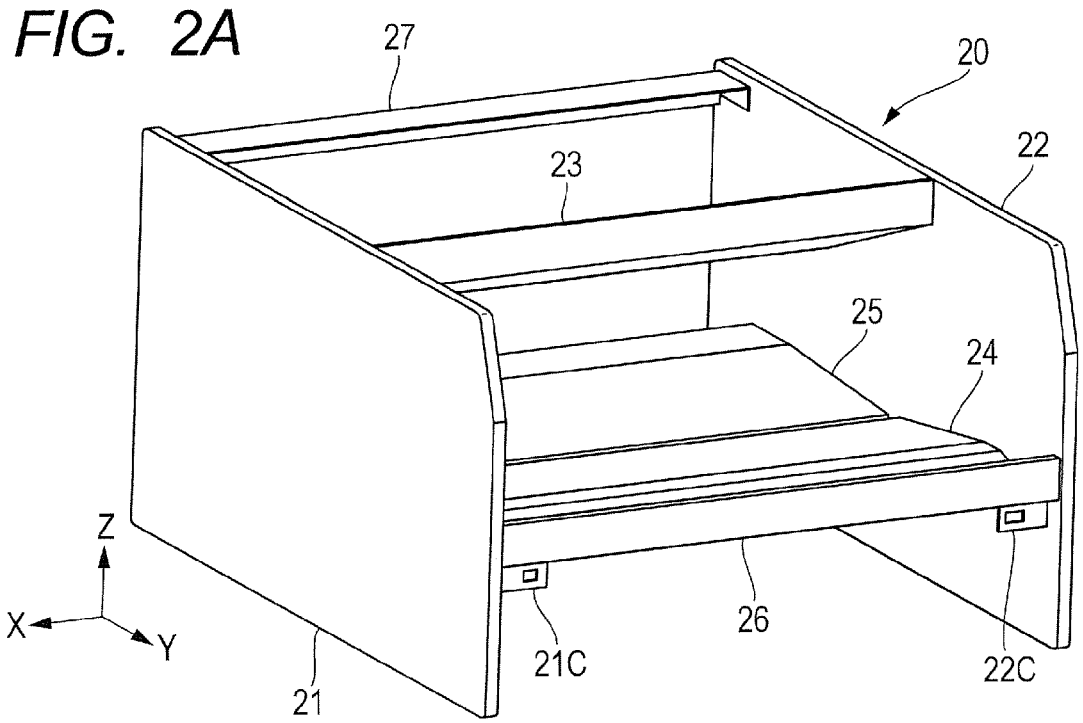
FIG. 2A shows a frame of an image forming apparatus in a perspective view observed from the upper left near side of a main body of the apparatus, according to a first embodiment.
Figure 2B:
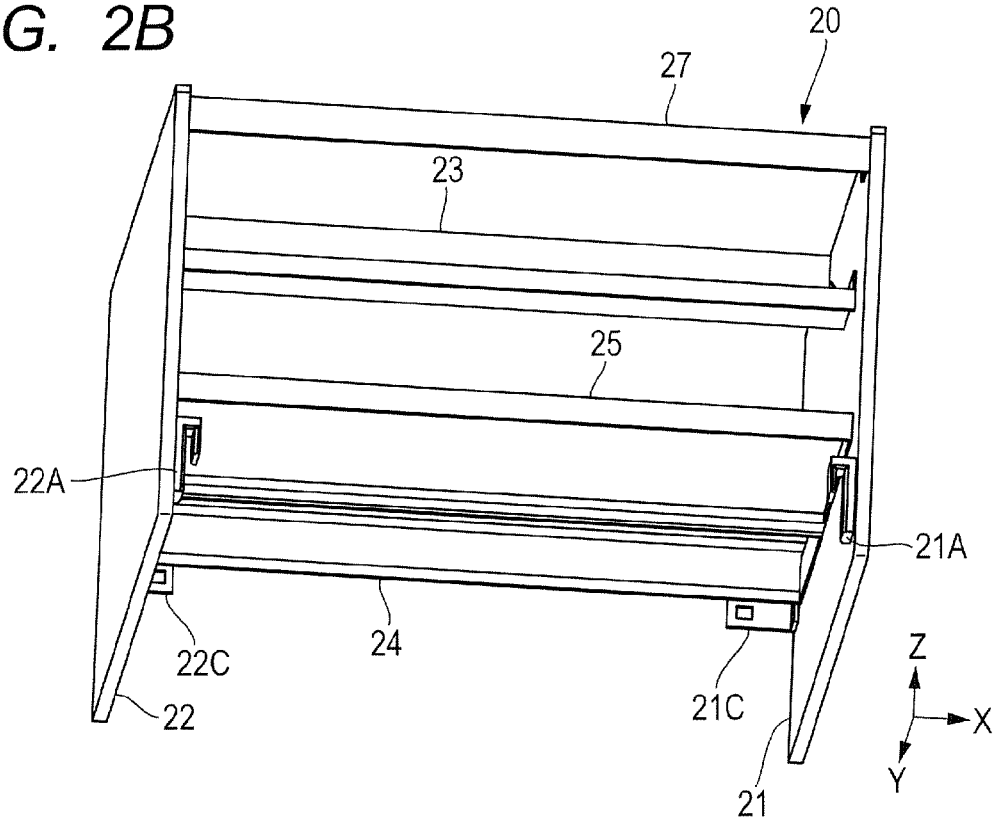
FIG. 2B shows the frame of the image forming apparatus in a perspective view observed from the lower right far side of the main body, according to the first embodiment.

The configuration of the frame is described with reference to FIG. 2A and FIG. 2B. FIG. 2A is a diagram illustrating a frame unit 20 of the main body 2, and is a perspective view observed from the upper left front side of the main body 2. FIG. 2B is a perspective view observed from the lower right back side of the main body 2.

The frame unit 20 includes side plates 21 and 22 (a first frame and a second frame) that are two frame members that support a drive unit and an electric component unit. In the following description, the side plates 21 and 22 are respectively referred to as the left side plate 21 and the right side plate 22 for the sake of convenience. The left and right side plates 21 and 22 are arranged parallel to each other with a predetermined distance therebetween, and the two side plates 21 and 22 are connected and fixed to each other by a plurality of members (connection portions) 23, 24, 25, 26 and 27. The member 23 (also referred to as the top plate 23) is a plate-like member that supports the laser scanner 122, and the member 24 is a registration unit supporting unit that supports the registration unit 105. The member 25 is a transfer roller supporting unit that supports the transfer roller 106. The member 26 is a stay that is provided on a surface (front surface) in the attachment and detachment (insertion and pull) direction of the universal cassette 1 and the process cartridge 111, and the member 27 is a stay that is provided above the sheet discharging roller pair 119. The interval between the left side plate 21 and the right side plate 22 is defined by connecting the left side plate 21 and the right side plate 22 to each other by the top plate 23, the registration unit supporting unit 24, the transfer roller supporting unit 25 and the stays 26 and 27.

A portion opposite to the side (front side) on which the universal cassette 1 is attached and detached with respect to the frame unit 20 is opened. This enables the universal cassette 1 to be extended when a sheet having a size that is larger than the size of the main body 2 in the right and left direction in FIG. 1 is placed on the universal cassette 1. In order to reduce the height of the main body and costs of the main body, a member that connects the lower ends of the left side plate 21 and the right side plate 22 to each other is not provided on the bottom surface (that is, the surface on the lower side of FIG. 1) of the main body, and a lower portion of the frame unit 20 is opened. The left side plate 21 and the right side plate 22 respectively include positioning and receiving portions 21C and 22C and main body engaged portions 21A and 22A that are made of independent members attached to the left side plate 21 and the right side plate 22.

(Configuration of Cassette Main Body)

Figure 3A:
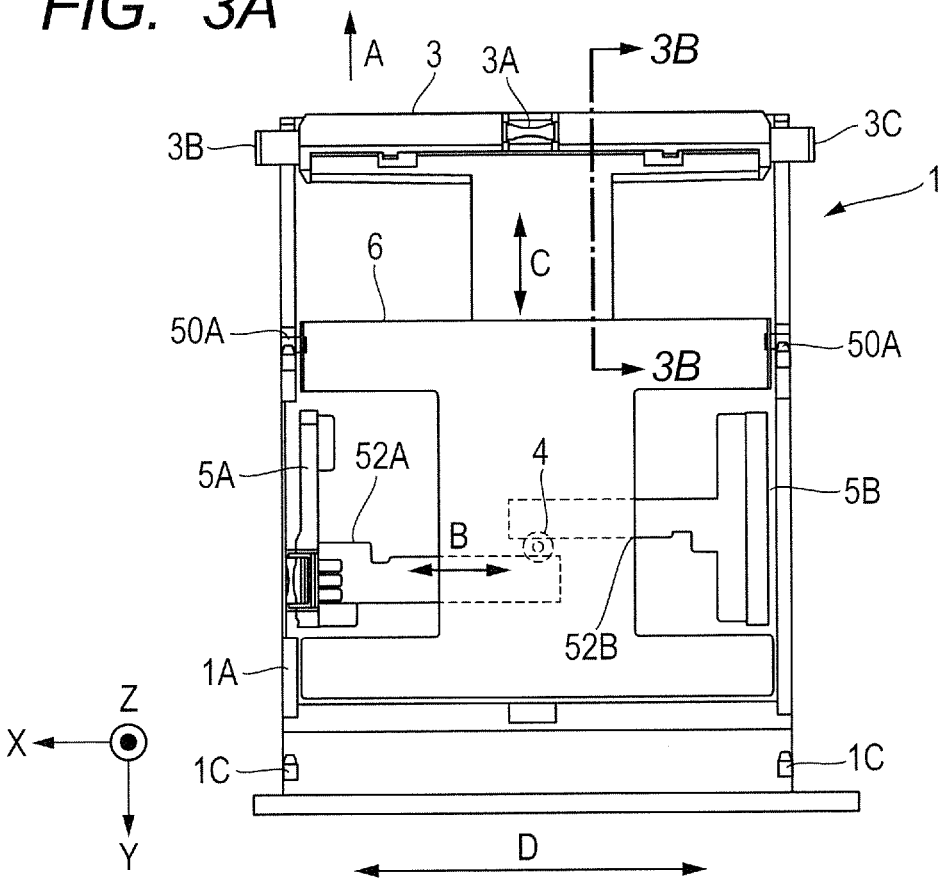
FIG. 3A shows the universal cassette of the image forming apparatus in a top view of the apparatus, according to the first embodiment.

The configuration of the universal cassette is described with reference to FIG. 3A and FIG. 3B. FIG. 3A is a diagram illustrating the universal cassette 1 as the sheet storing unit. The universal cassette 1 includes: the cassette main body 1A that stores sheets having various sizes; a pair of side-end regulation members (side-end regulation plates) 5A and 5B that regulate the side-end positions of each sheet; and a back-end regulation member (back-end regulation plate) 3 that regulates the back-end position of each sheet. The back-end regulation member 3 is supported by the cassette main body 1A, and abuts against end portions of the sheets stacked on the middle plate 6 to regulate the positions of the sheets. Positioning units 1C and 1C are respectively provided to both the end portions of the front surface on the near side of the cassette 1. The side-end regulation members 5A and 5B and the back-end regulation member 3 are arranged so as not to influence a turning operation of the middle plate 6. When sheets having various sizes are stored into the cassette main body that is the sheet storing unit main body, the side-end positions of each sheet are regulated by causing the side-end regulation members 5A and 5B to abut against the side ends of the sheet, and the back-end position of each sheet is regulated by causing the back-end regulation member 3 to abut against the back end of the sheet. In this way, the sheets can be stored in a positioned state. The movement direction of the back-end regulation member 3 with respect to the cassette main body 1A is coincident with the attachment and detachment (insertion and pull) direction of the frame unit 20 of the universal cassette 1.

Figure 3B:
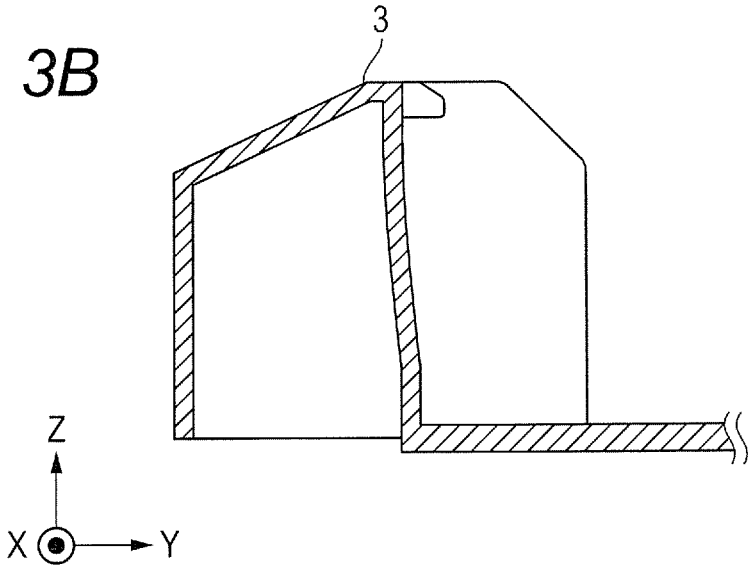
FIG. 3B shows the universal cassette of the image forming apparatus in a cross-sectional view of a back-end regulation member, according to the first embodiment.

FIG. 3B is a cross-sectional view of the back-end regulation member 3, which is taken along a line V1-V1 in FIG. 3A. As illustrated in FIG. 3B, the back-end regulation member 3 has one of a box-like substantially U-shape and a shape equivalent thereto, and is integrally formed over the entire width in the sheet width direction (a direction of an arrow D) of the cassette main body 1A. Accordingly, the back-end regulation member 3 serves as a strengthening member having a predetermined stiffness to external force in the compression/extension and bending directions thereof.

Next, when sheets are fed, the universal cassette 1 on which a bundle of the sheets is placed is attached to the inside of the main body from the apparatus front side indicated by the direction of the arrow A. The universal cassette 1 is positioned and fixed by connecting at least two positioning units 1C provided to the universal cassette 1 and the positioning and receiving portions 21C and 22C provided to the main body 2 (FIG. 2A, FIG. 2B, FIG. 3A and FIG. 3B). In order to prevent the universal cassette 1 from unexpectedly coming off, a lock unit (not illustrated) may also be provided together with the positioning units 1C. The lock unit is adopted not to disturb a user's operation of pulling the universal cassette 1 out of the main body 2 in the case of refilling with sheets and other cases.

When the universal cassette 1 is inserted into an attached state where the universal cassette 1 can feed sheets toward the image forming unit, the middle plate 6 (see FIG. 1) is pushed up by the coil spring 51 (see FIG. 1) about the shaft 50A as the fulcrum. Consequently, the sheets positioned by the side-end regulation members 5A and 5B and the back-end regulation member 3 are pressed against the sheet feeding roller 103A. The sheets thus pressed against the sheet feeding roller 103A are fed one by one by a feeding action of the sheet feeding roller 103A, and are fed to the image forming unit 102.

The pair of side-end regulation members 5A and 5B respectively include rack parts 52A and 52B in lower portions thereof, the rack parts 52A and 52B extending in the same direction (a direction of an arrow B) as the width direction that is the movement direction of the side-end regulation members 5A and 5B. The rack parts 52A and 52B are movable in the width direction while being guided by guide grooves (not illustrated) that are provided in the direction of the arrow B to a bottom plate of the cassette main body 1A. A rotatable pinion 4 is provided in a central part of the bottom surface of the cassette main body 1A, and rack teeth formed in each of the rack parts 52A and 52B engage with the pinion 4. With this structure, if any one of the side-end regulation members is moved in the width direction, the other of the side-end regulation members moves in conjunction therewith in the direction opposite to the movement of the one of the side-end regulation members, due to an action between the pinion 4 and the rack parts 52A and 52B.

By moving the one of the side-end regulation members in this way, both the side-end regulation members 5A and 5B are moved in the width direction at the same time, to be thereby caused to abut against the side ends of the sheets stacked on the middle plate 6. In this way, positioning of the sheets in the width direction can be facilitated. The back-end regulation member 3 is movable in the sheet feeding direction while being guided by a guide groove (not illustrated) that is provided in a direction of an arrow C to the bottom plate of the cassette main body 1A. In the present embodiment, a lock (not illustrated) provided to the back-end regulation member 3 engages with the cassette main body 1A, whereby the back-end regulation member 3 is fixed. The engagement between the lock (not illustrated) and the cassette main body 1A is cancelled by operating a lever 3A provided to the back-end regulation member 3, whereby the back-end regulation member 3 becomes movable in the sheet feeding direction.

The back-end regulation member 3 includes rear-end regulation member engaging portions 3B and 3C (to be described later) in both the end portions in the longitudinal direction of the back-end regulation member 3. In the case where the back-end regulation member 3 is at a predetermined position with respect to the cassette main body 1A, in the state where the cassette 1 is attached to the main body 2 (frame unit 20), the engaging portions 3B and 3C are respectively engageable with the main body engaged portions 21A and 22A with a predetermined gap therebetween.

(Configurations and Actions of Engaging Portions and Engaged Portions)

Figure 4A:
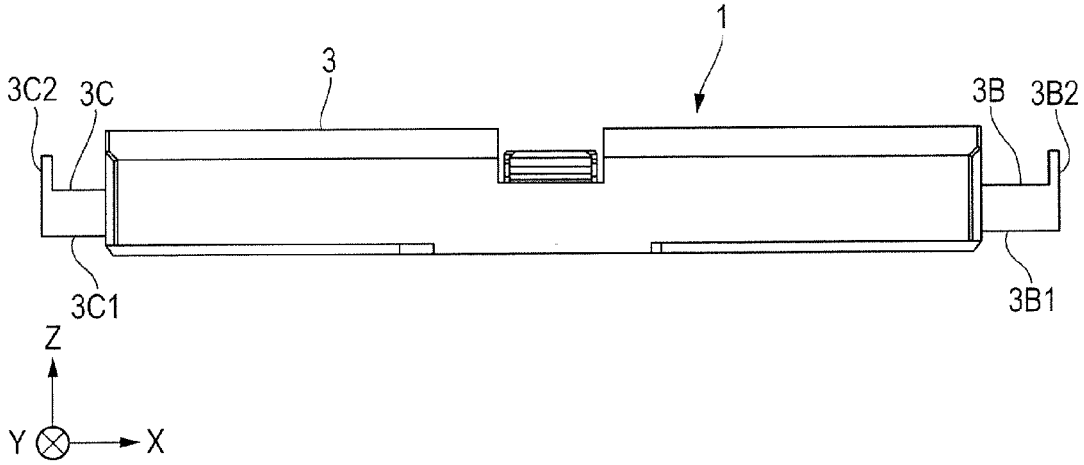
FIG. 4A shows a back view of the universal cassette at engaging portions according to the first embodiment.

The configurations and actions of the rear-end regulation member engaging portions 3B and 3C and the main body engaged portions 21A and 22A are described with reference to FIG. 4A to FIG. 7B. FIG. 4A is a detailed diagram of the rear-end regulation member engaging portions 3B and 3C when the main body 2 is observed from the back side thereof. The rear-end regulation member engaging portions (first end portion) 3B and (second end portion) 3C respectively provided to both the end portions of the back-end regulation member 3 each have a substantially L-shape. The engaging portion 3B and the engaging portion 3C of the back-end regulation member 3 are connected to each other by an extension part that extends in the direction orthogonal to the insertion and pull direction of the cassette 2. That is, the engaging portions 3B and 3C respectively include extending portions 3B1 and 3C1 and projections 3B2 and 3C2. The extending portions 3B1 and 3C1 respectively extend outward in the width direction from the left and right ends of the back-end regulation member 3. The projections 3B2 and 3C2 are each made of a plate-like member having a predetermined length. The projections 3B2 and 3C2 respectively bend and extend upward from the leading ends of the extending portions 3B1 and 3C1, and each extend in the insertion and pull direction of the universal cassette along a plane orthogonal to the width direction of the cassette main body.

Figure 4B:
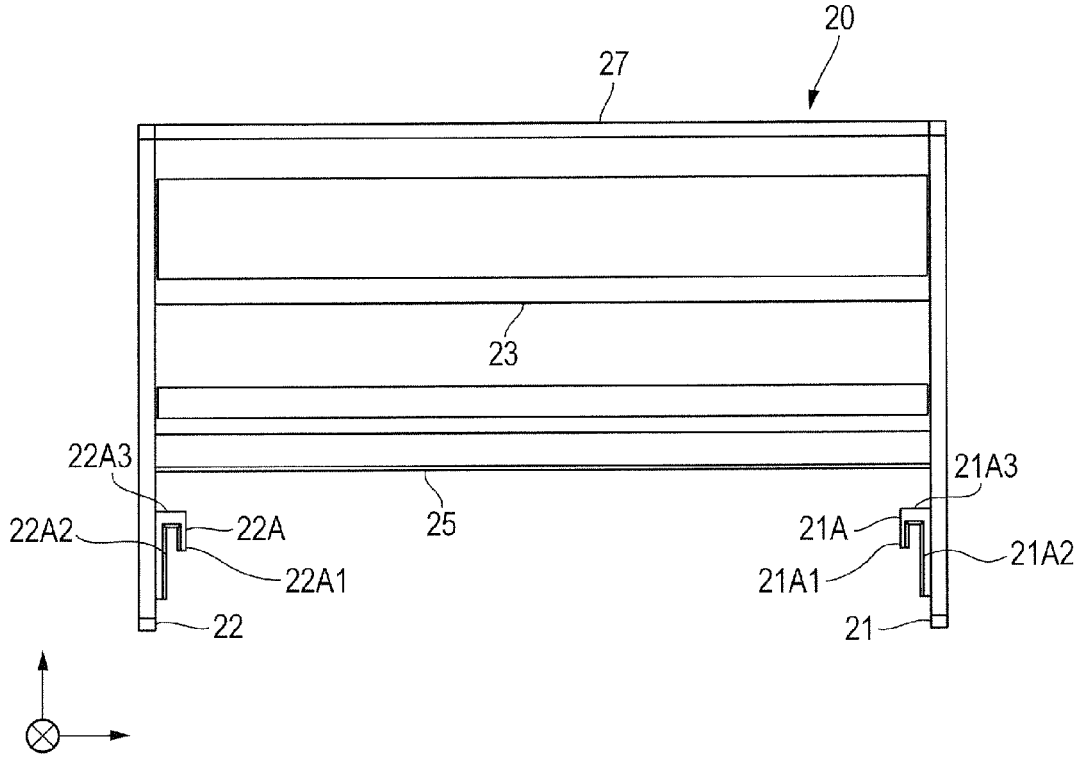
FIG. 4B shows a back view of the frame at engaged portions according to the first embodiment.
Figure 5A:
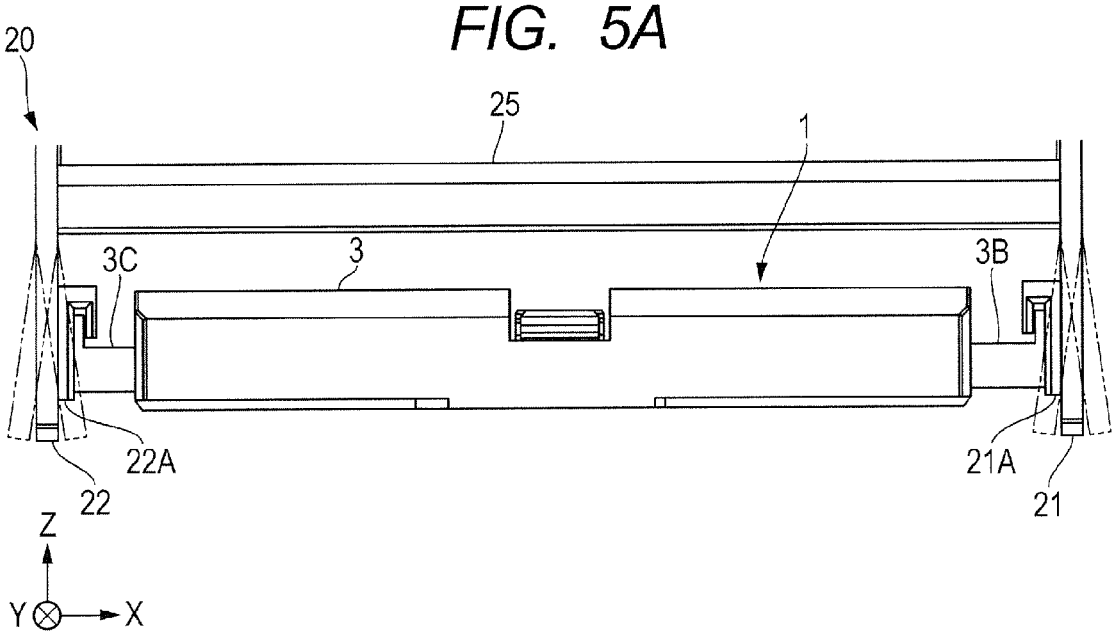
FIG. 5A shows the engaging portions and the engaged portions of the image forming apparatus in a back view of the frame and the universal cassette in an engaged state, according to the first embodiment.
Figure 5B:
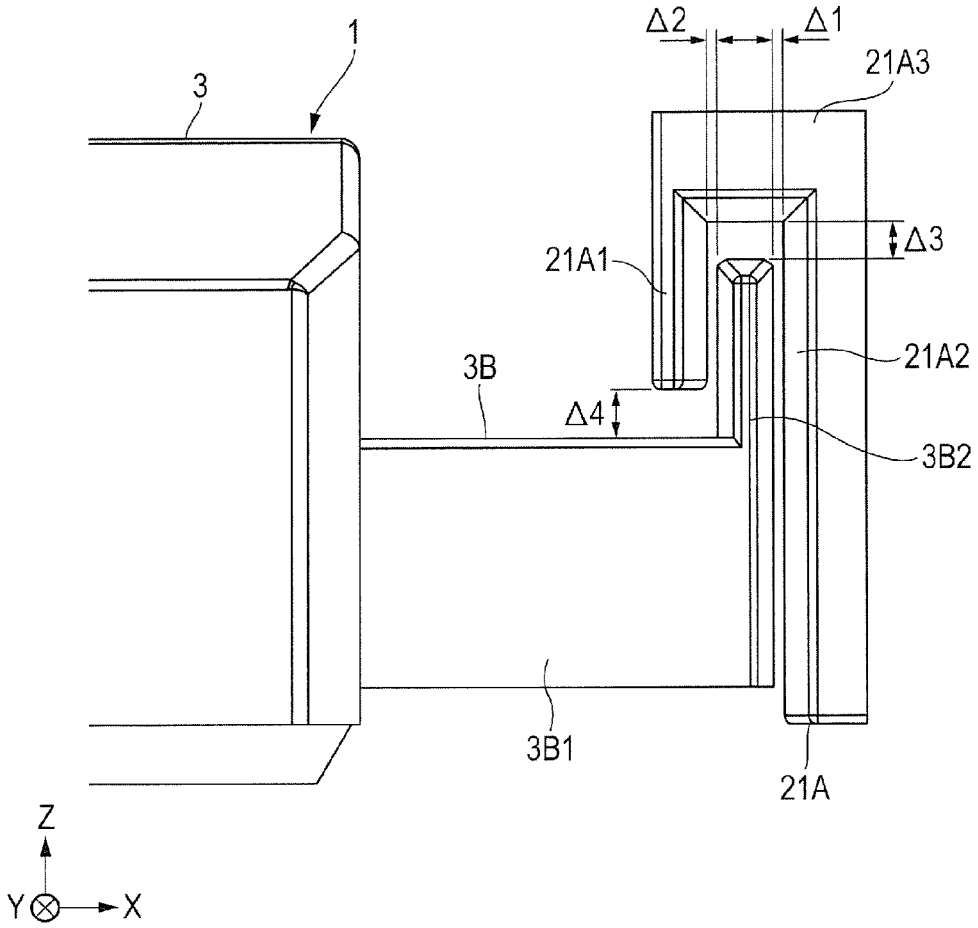
FIG. 5B shows the engaging portion and the engaged portion of the image forming apparatus in a partial enlarged view of the engaged portion, according to the first embodiment.
Figure 6A:
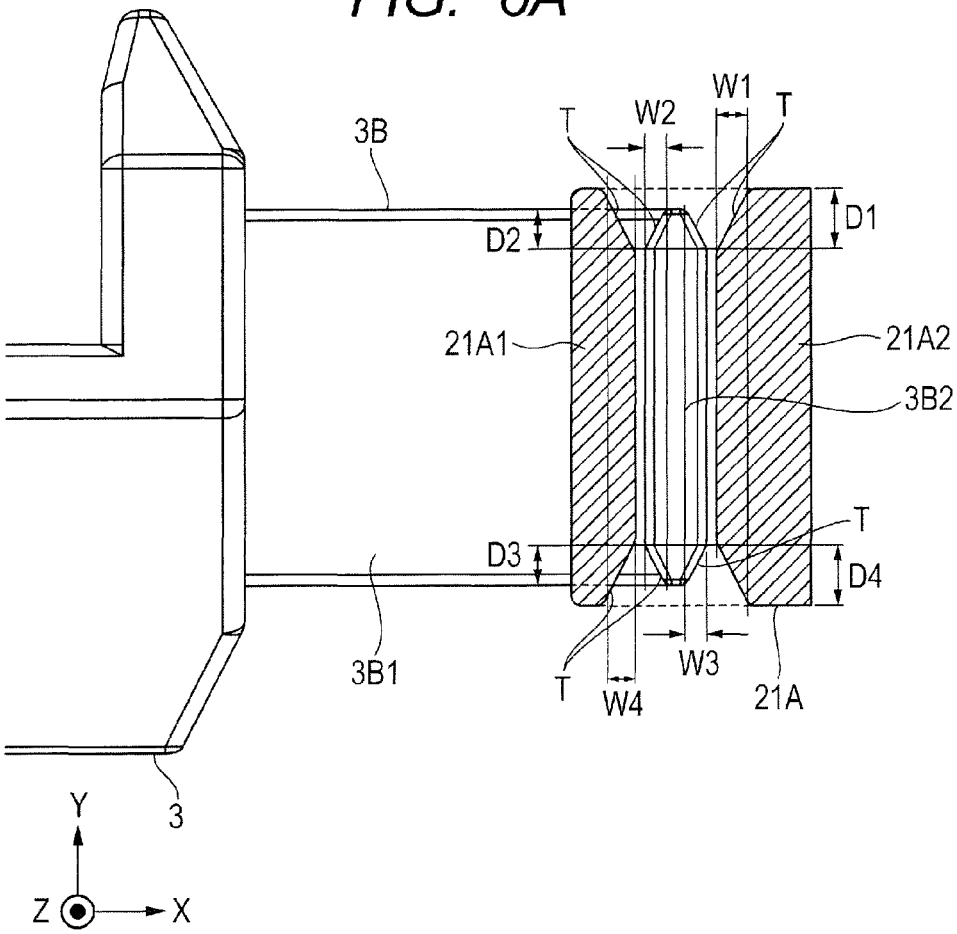
FIG. 6A shows an engaged state of the rear-end regulation member engaging portion and the main body engaged portion of the image forming apparatus in the enlarged top view of the apparatus, according to the first embodiment.
Figure 6B:
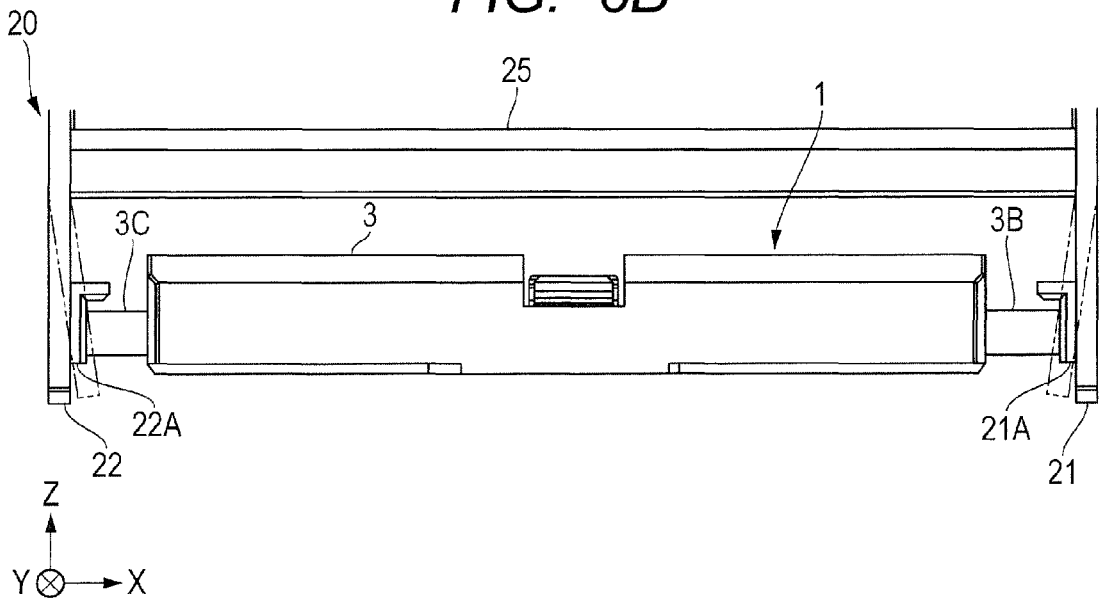
FIGS. 6B and 6C show the engaged state of the rear-end regulation member engaging portions and the main body engaged portions of the image forming apparatus in a back view of the apparatus, according to the first embodiment.
Figure 7A:
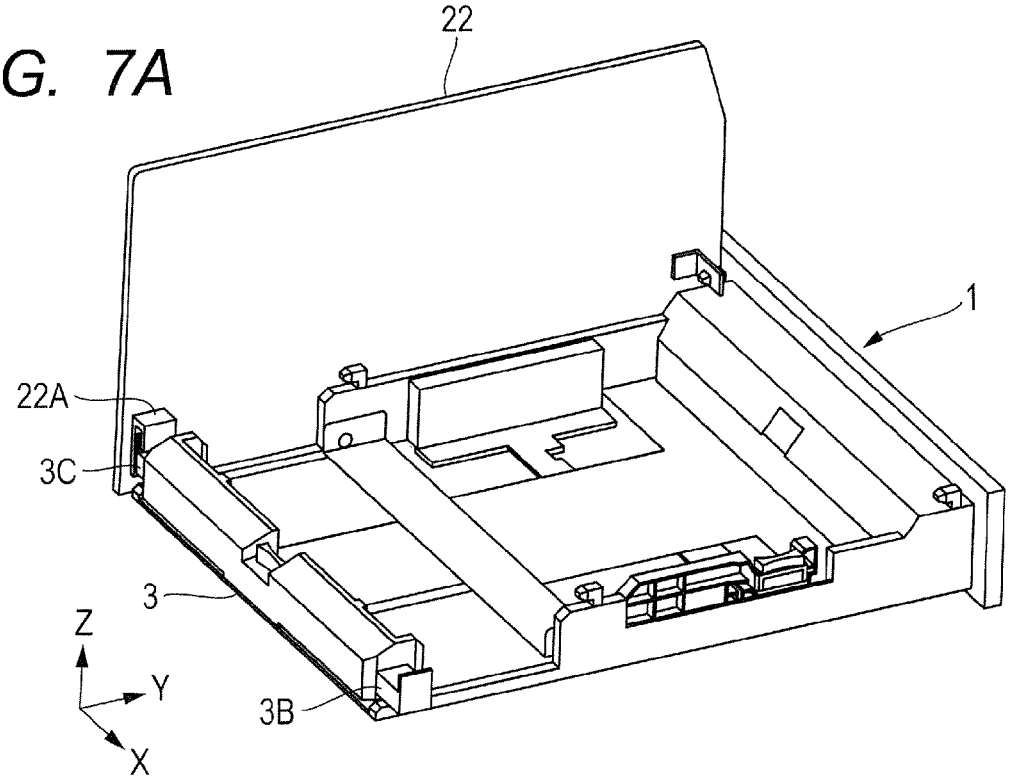
FIG. 7A shows a perspective view of a main part of the image forming apparatus in the engaged state of the rear-end regulation member engaging portions and the main body engaged portions, according to the first embodiment.
Figure 7B:
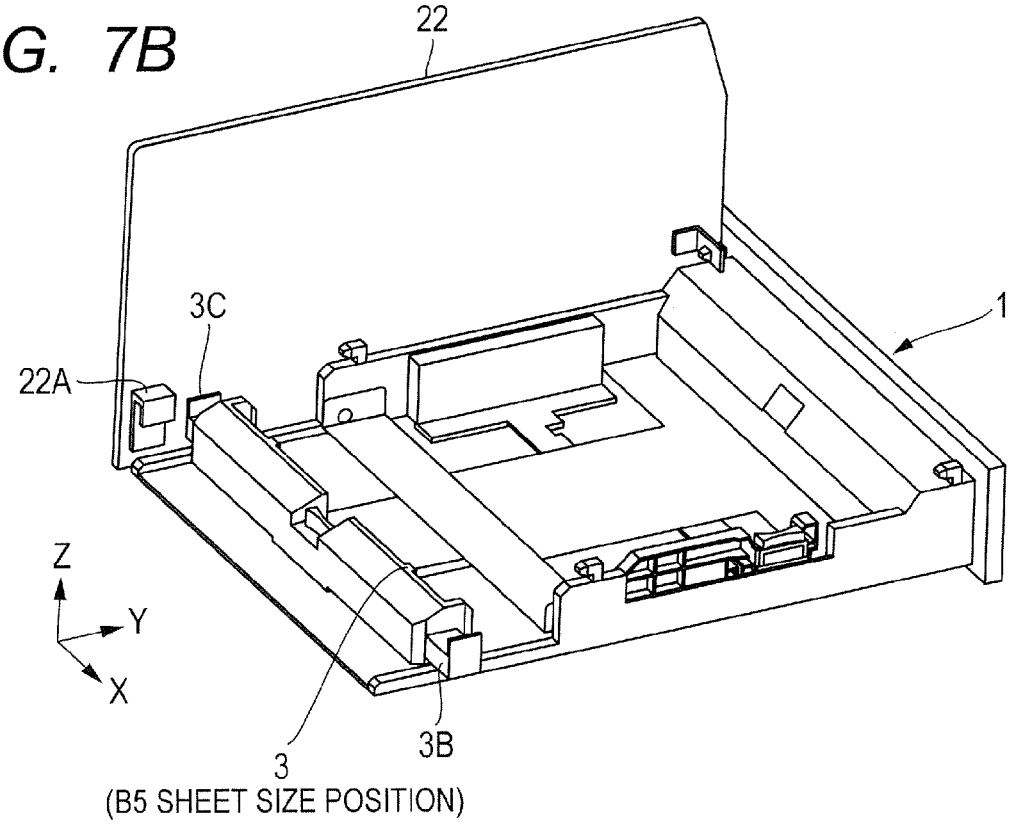
FIG. 7B shows a non-engaged state of the rear-end regulation member engaging portions and the main body engaged portions.

FIG. 4B is a detailed diagram of the main body engaged portions 21A and 22A when the main body 2 is observed from the back side thereof. The main body engaged portions 21A and 22A respectively provided to the left side plate 21 and the right side plate 22 have such substantially concave shapes that can engage with the rear-end regulation member engaging portions 3B and 3C. That is, the engaged portion 21A is made of a groove including two side parts 21A1 and 21A2 and a bottom par 21A3, and the engaged portion 22A is made of a groove including two side parts 22A1 and 22A2 and a bottom portion 22A3. The two side parts 21A1 and 21A2 (22A1 and 22A2) are opposedly arranged parallel to each other with a predetermined distance therebetween so as to sandwich the plate-like projection 3B2 (3C2) of the engaging portion. The bottom portion 21A3 (22A3) connects the two side parts in the upper end portion. FIG. 5A is a diagram illustrating an engaged state and an action of the rear-end regulation member engaging portions 3B and 3C and the main body engaged portions 21A and 22A when the main body 2 is observed from the back side thereof. FIG. 5B is a diagram illustrating a dimensional relation in the engaged state of the rear-end regulation member engaging portions 3B and 3C and the main body engaged portions 21A and 22A, when the main body 2 is observed from the back side thereof, and FIG. 6A is a diagram illustrating a dimensional relation in the engaged state thereof, when the main body 2 is observed from the upper side thereof. FIG. 7A and FIG. 7B are diagrams illustrating whether or not the rear-end regulation member engaging portions 3B and 3C and the main body engaged portions 21A and 22A are in the engaged state, depending on a difference in position of the back-end regulation member 3, when the main body 2 is observed from the upper left side thereof. In FIG. 7A and FIG. 7B, the left side plate 21 is omitted for ease of description.

As described above for the configuration of the universal cassette, sheets having a predetermined size are stored in the cassette main body 1A, and the back-end regulation member 3 regulates the back ends of the sheets having a predetermined size. In this state, the cassette 1 is inserted into the main body 2 (frame unit 20). In the state where the cassette 1 is attached at a sheet feeding position at which the cassette 1 can feed the sheets, the rear-end regulation member engaging portion 3B engages with the main body engaged portion 21A with a predetermined gap therebetween, and the rear-end regulation member engaging portion 3C engages with the main body engaged portion 22A with a predetermined gap therebetween (FIG. 5A, FIG. 5B, FIG. 6A and FIG. 6B). The predetermined gap may be selected as appropriate according to the sizes, weights, and stiffnesses of the main body 2 and the universal cassette 1. As an example, in FIG. 5B, dimensions Δ1 and Δ2 are set to 0.5 [mm], and dimensions Δ3 and Δ4 are set to 2.0 [mm].

In the case where the gap in each engagement portion is set to be small, tapered parts T are provided in order to prevent impairment in operability when the universal cassette 1 is inserted into the main body 2. The shape and dimensions of the tapered parts T may be selected as appropriate similarly to the above. As an example, in FIG. 6A, dimensions W1 and W4 are set to 1.5 [mm], dimensions D1 and D4 are set to 3.0 [mm], dimensions W2 and W3 are set to 1.0 [mm], and dimensions D2 and D3 are set to 2.0 [mm]. The tapered parts T are respectively provided to both the engaging portion 3B and the engaged portion 21A, but the tapered part T may be provided to only any one thereof. Similarly, the tapered parts T are provided in both the insertion direction and the pull direction with respect to the main body (frame) of the cassette 1, but the tapered part T may be provided in only the insertion direction.

In the case where the bottom surface of the main body is opened for the purpose of reducing the size of the main body, particularly, the size thereof in the height direction, the lower portions (particularly, on the far side of the main body) of the left side plate 21 and the right side plate 22 have a low stiffness to external force in the horizontal right and left direction (an X-axis direction in the drawings). In particular, impact force may be exerted in the X-axis direction during transportation of the main body and the like. Under such a circumstance, the lower portions of the left side plate 21 and the right side plate 22 may plastically deform (see alternate long and two short dashes lines in FIG. 5A). In the case where the main body is used with such a plastic deformation as described above, an image failure and a sheet feeding failure resulting from distortion of the frame of the main body occur more easily. In the case where the plastic deformation is significant, components built in the main body may be damaged.

In the state where the rear-end regulation member engaging portions 3B and 3C respectively engage with the main body engaged portions 21A and 22A as in the present embodiment, when the impact force is exerted in the X-axis direction, the back-end regulation member 3 serves as a stay, and functions as a strengthening member for both the left side plate 21 and the right side plate 22. Consequently, deformation of the left side plate 21 and the right side plate 22 can be suppressed within the range of the above-mentioned gap, that is, the range of elastic deformation. In other words, the back-end regulation member 3 prevents at least part of the left side plate 21 and/or the right side plate 22 from deforming inward in the direction orthogonal to the insertion and pull direction of the cassette 2.

If the back-end regulation member 3 is not at the predetermined position, the rear-end regulation member engaging portion 3B does not engage with the main body engaged portion 21A, and the rear-end regulation member engaging portion 3C does not engage with the main body engaged portion 22A.

Normally, the back-end regulation member 3 is movable in the sheet feeding and conveying direction as described above. Hence, in order to always engage the engaging portions with the engaged portions, the main body engaged portions 21A and 22A need to be designed so as to be compatible with all sheet sizes supported by the universal cassette 1. Consequently, the sizes of the main body engaged portions 21A and 22A thus designed become larger. In such a case, because the back end regulation position changes so as to suit the size of a placed bundle of sheets, a contact state and a contact position of the rear-end regulation member engaging portions 3B and 3C and the main body engaged portions 21A and 22A may change, and unexpected interference therebetween may occur accordingly. As a result, the universal cassette 1 may deviate from a position to be defined by engagement between the two positioning units 1C and the positioning and receiving portions 21C and 22C, with respect to the main body 2. In this case, problems of an image failure and a sheet feeding failure occur.

Figure 8A:
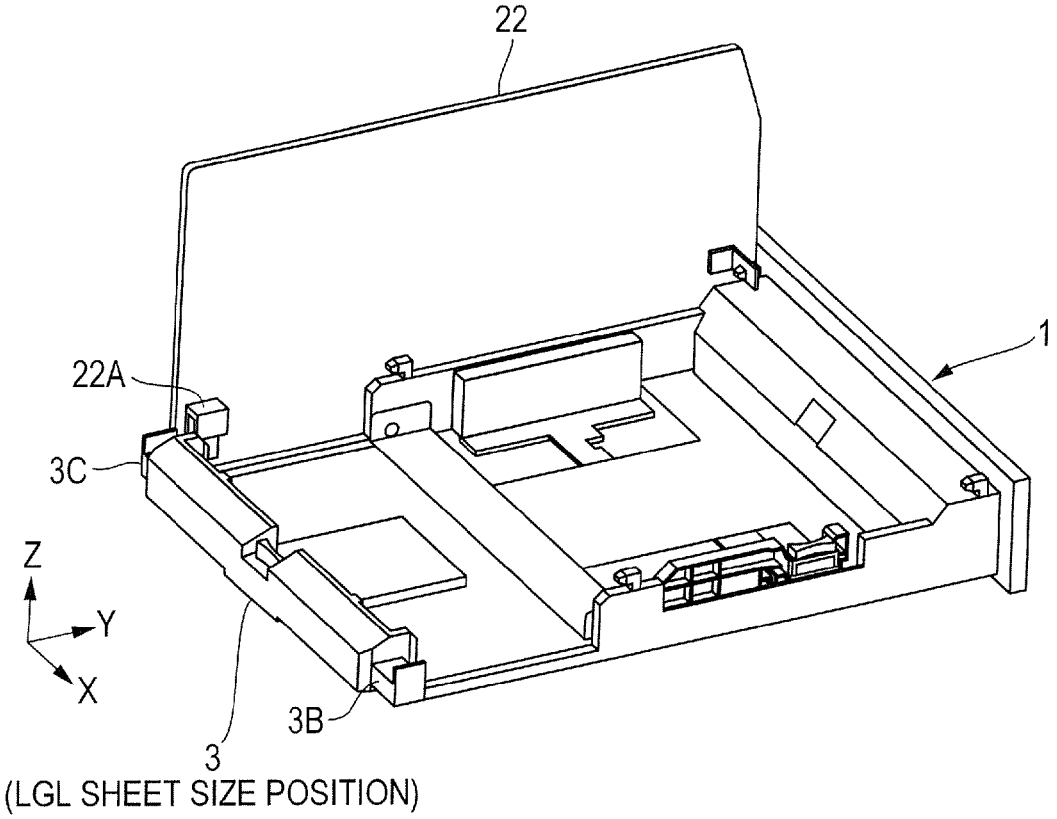
FIG. 8A shows the non-engaged state of the rear-end regulation member engaging portions and the main body engaged portions of the image forming apparatus in the view observed from the upper left side of the apparatus, according to the first embodiment.

To deal with this, in the present embodiment, whether or not the engaging portions respectively engage with the engaged portions depends on the position of the back-end regulation member 3. That is, in the case where the back-end regulation member 3 is located at a position at which the back end of sheets having a predetermined size (for example, A4) is regulated, as illustrated in FIG. 7A, the engaging portions 3B and 3C respectively engage with the engaged portions 21A and 22A. In the case where the back-end regulation member 3 is located at a position at which the back end of sheets having a size (for example, B5) smaller than the predetermined size is regulated, as illustrated in FIG. 7B, the engaging portions 3B and 3C do not respectively engage with the engaged portions 21A and 22A. In the case where the back-end regulation member 3 is located at a position at which the back end of sheets having a size (for example, LGL) larger than the predetermined size is regulated, as illustrated in FIG. 8A, the engaging portions 3B and 3C do not respectively engage with the engaged portions 21A and 22A.

With this structure, the position at which the rear-end regulation member engaging portions 3B and 3C respectively engage with the main body engaged portions 21A and 22A can be limited, and hence the unexpected interference caused by a change in contact state and contact position can be prevented. Accordingly, a favorable image and a favorable sheet feeding state can be obtained. At the same time, the sizes of the main body engaged portions 21A and 22A can be reduced, and hence an unnecessary increase in cost can be suppressed.

During transportation of the laser beam printer 100, the back-end regulation member 3 is set to the position at which the back end of the sheets having the predetermined size is regulated. In this state, the laser beam printer 100 is transported in the state where the universal cassette 1 is attached to the main body 2 and where the engaging portions 3B and 3C respectively engage with the engaged portions 21A and 22A. The position of the back-end regulation member 3 at which the rear-end regulation member engaging portions 3B and 3C respectively engage with the main body engaged portions 21A and 22A may be selected as appropriate depending on the configuration of the main body (arrangement of the frame and the like). In the present embodiment, this position of the back-end regulation member 3 is set to a position coincident with an end portion of a standard-size sheet (for example, A4 sheet size). If this position of the back-end regulation member 3 is made coincident with a size frequently used by a user, the amount of work of the user at the initial use can be reduced. The main body engaged portions 21A and 22A may be lengthened in the insertion and pull direction of the cassette, whereby the engaging portions 3B and 3C may respectively engage with the lengthened main body engaged portions 21A and 22A at positions at which the back-end regulation member 3 regulates the back ends of the sheets having a plurality of sizes.

In the present embodiment, the rear-end regulation member engaging portions 3B and 3C each have a substantially L-shape, and the main body engaged portions 21A and 22A each have a substantially concave shape. The directions and shapes of the engaging portions and the engaged portions may be a substantially T-shape and a substantially hook-like shape as well as a given shape with a predetermined gap (for example, a shape in FIG. 6B). In the present embodiment, the main body engaged portions 21A and 22A are components independent of the left side plate 21 and the right side plate 22, but may be directly formed in the left side plate 21 and the right side plate 22.

Figure 6C:
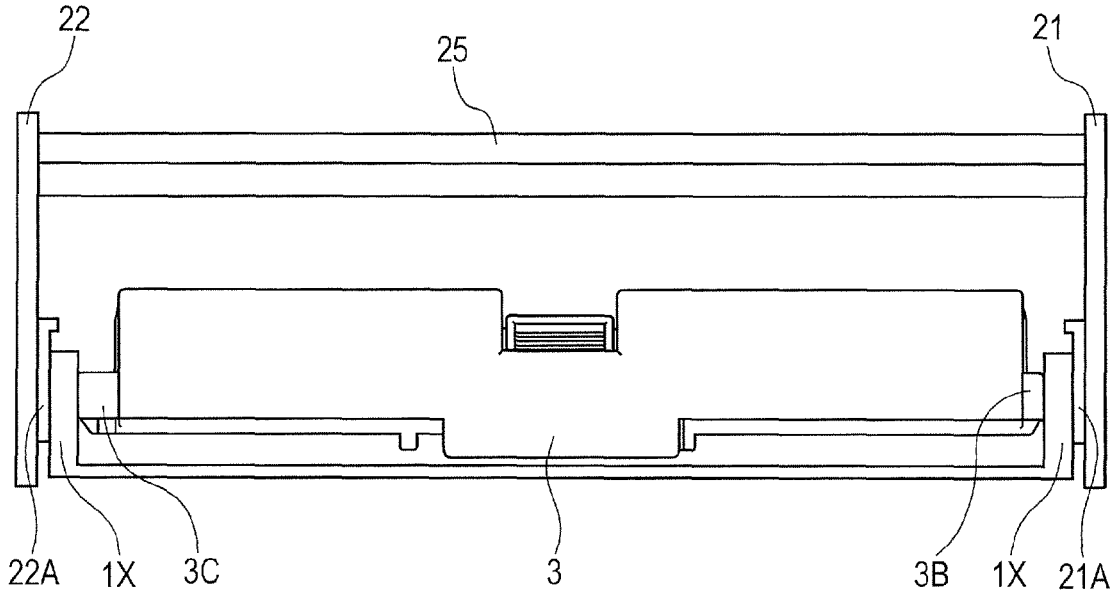

Also, the present invention is not limited to the aforementioned embodiment. As shown in FIG. 6C, it is allowed to provide the side wall 1X of the cassette between the rear-end regulation member and the main body engaged members 21A and 22A. In this case, the deforming of at least part of the left side plate 21 and/or the right side plate 22 is restricted by abutting the sidewall 1X of the cassette 1 against the main body engaged members 21A and 22A, and abutting the sidewall 1X of the cassette 1 against the rear-end regulation member engaging portions 3B and 3C.

In the present embodiment, the rear-end regulation member engaging portions 3B and 3C respectively engage with the engaged portions 21A and 22A with, for example, a predetermined distance that absorbs elastic deformation of the left and right side plates 21 and 22. Accordingly, even in the case where the side plates 21 and 22 try to deform by such a predetermined amount or larger that causes, for example, plastic deformation thereof, the back-end regulation member 3 including the engaging portions serves as a strengthening member to regulate the deformation. Alternatively, the engaging portions 3B and 3C may respectively engage in contact with the engaged portions 21A and 22A without any gap therebetween, and the back-end regulation member 3 including the engaging portions may serve as a strengthening member to regulate the deformation of the two side plates 21 and 22. That is, the engaging portions that respectively engage with the engaged portions and a portion (back-end regulation member) between the two engaging portions of the sheet storing unit (universal cassette) serve as strengthening members to regulate the deformation of the two frame members by at least the predetermined amount. Specifically, the engaging portions are respectively provided to both the end portions in the longitudinal direction of the back-end regulation member, and the back-end regulation member including the engaging portions serves as the strengthening member.

Second Embodiment

A second embodiment of the present invention is described with reference to the drawings. In the present embodiment, configurations and operations of the same portions as those in the first embodiment are omitted, and only portions different therefrom are described.

Figure 9A:
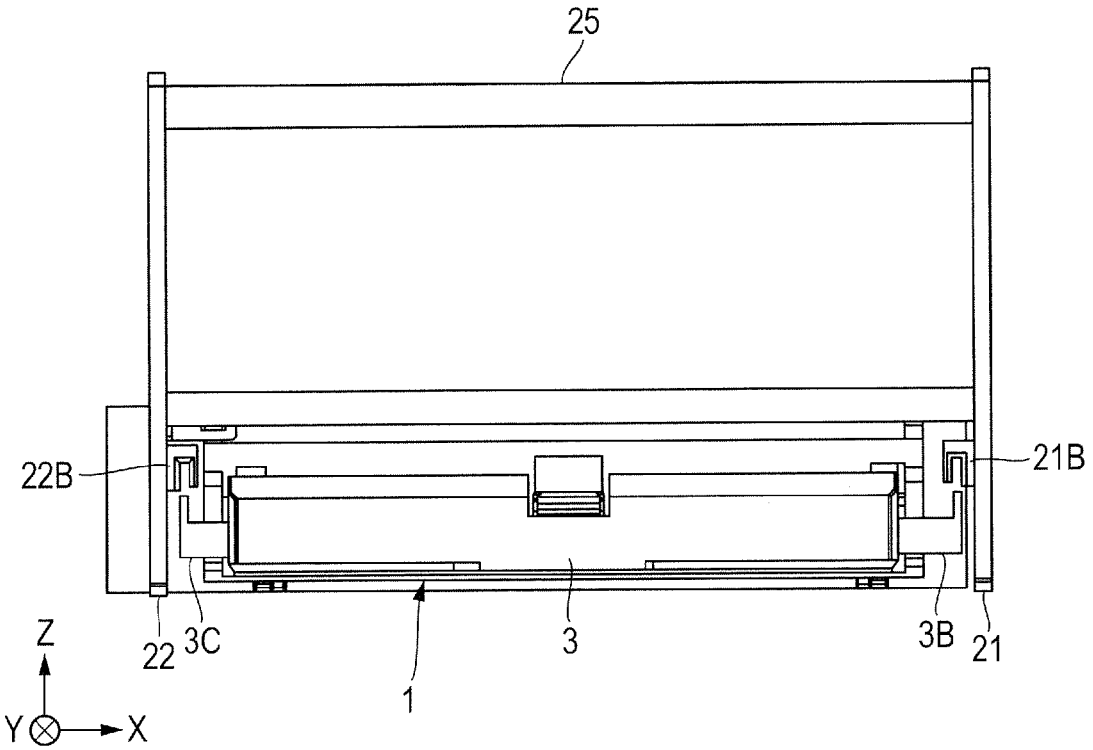
FIG. 9A shows a state where a packaging material is not used and where rear-end regulation member engaging portions and main body engaged portions of an image forming apparatus do not engage with each other in a back view of the apparatus, according to the second embodiment.
Figure 9B:
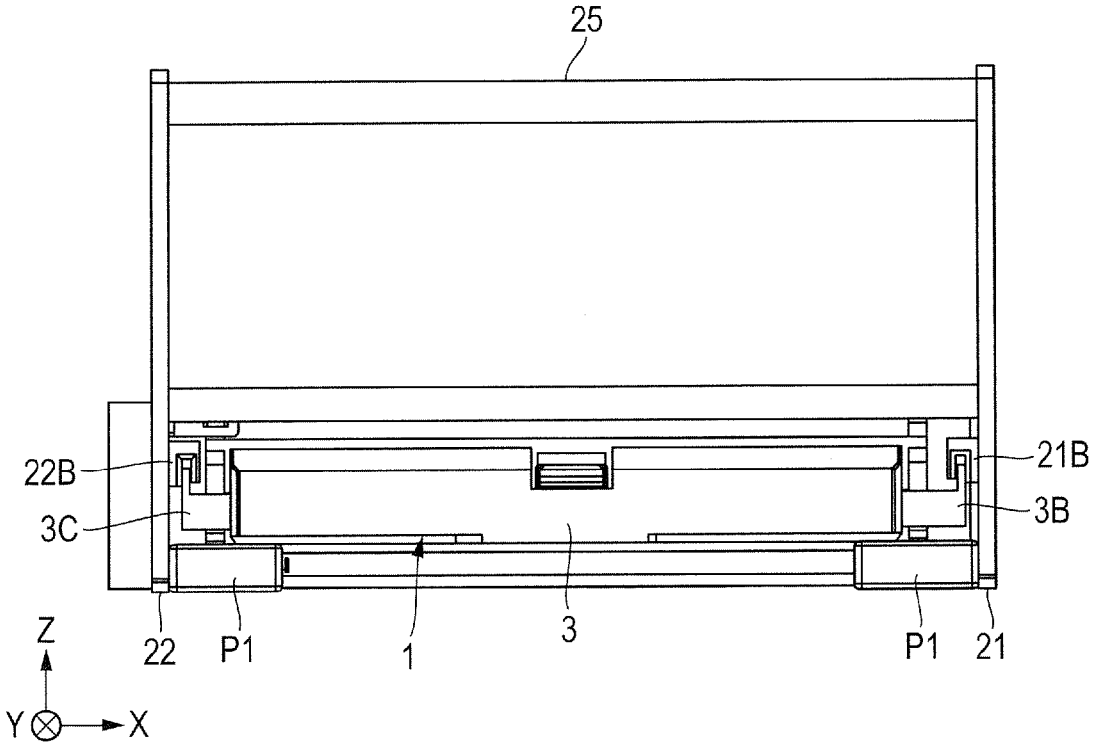
FIG. 9B shows a state where the packaging material is used and where the rear-end regulation member engaging portions of the image forming apparatus, the main body engaged portions thereof and the packaging material engage with one another, according the second embodiment.
Figure 10A:
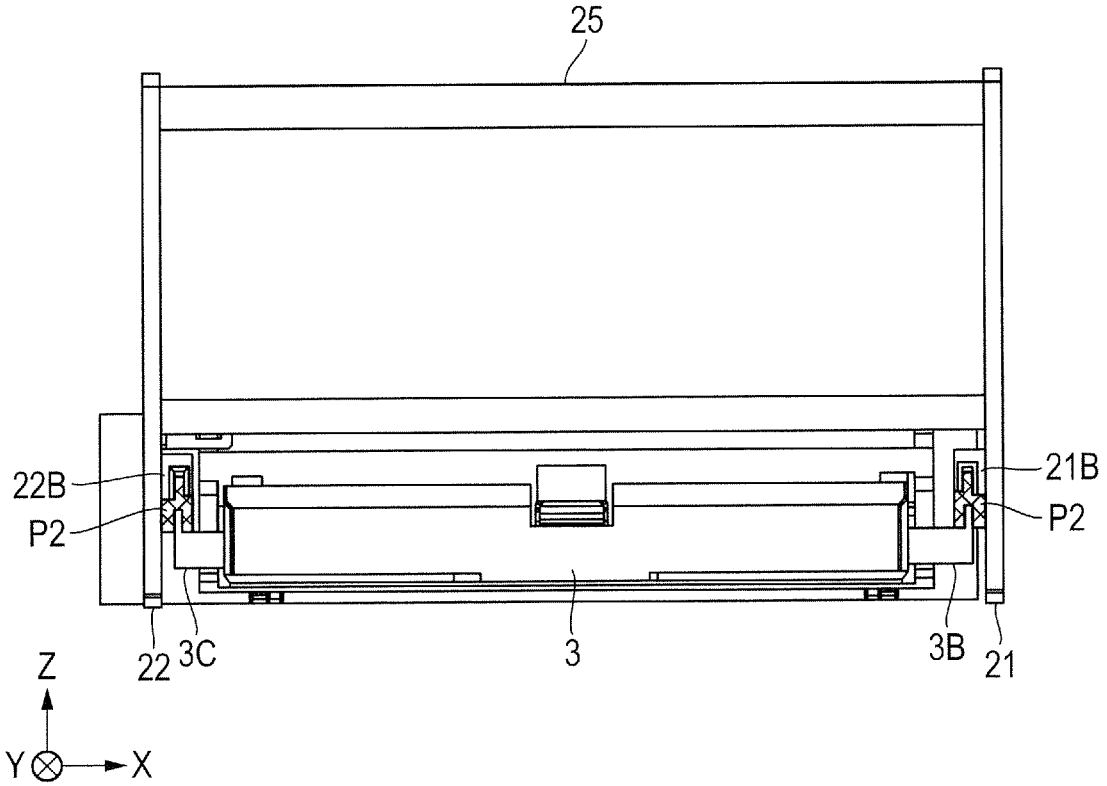
FIG. 10A shows a modified example of the second embodiment in a back view of the apparatus.

FIG. 9A is a diagram illustrating configurations of respective engaging portions of the main body 2 and the back-end regulation member 3 according to the present embodiment, when the main body 2 is observed from the back side thereof. As illustrated in FIG. 9A, in the present embodiment, at whichever position the back-end regulation member 3 is with respect to the cassette main body 1A, the rear-end regulation member engaging portions 3B and 3C do not respectively engage with main body engaged portions 21B and 22B. FIG. 9B and FIG. 10A each illustrate a configuration when the main body 2 is packaged for transportation. As illustrated in FIG. 9B, for example, a packaging material P1 is interposed between a bottom portion of the universal cassette 1 and a cardboard box, and the universal cassette is supported by the packaging material P1. Accordingly, the universal cassette 1 is inserted in the main body 2 while being supported by the packaging material P1, in the state where the position and posture thereof are different. In this state, the rear-end regulation member engaging portions 3B and 3C respectively engage with the main body engaged portions 21B and 22B with a predetermined gap therebetween. Accordingly, similarly to the first embodiment, even if external force in the plate surface direction is exerted on the lower portions (particularly, on the far side of the main body) of the left side plate 21 and the right side plate 22, deformation of the left side plate 21 and the right side plate 22 can be suppressed within the range of the above-mentioned gap, that is, the range of elastic deformation.

In addition, the size of the packaging material can be reduced compared with the case where the deformation of the lower portions of the left side plate 21 and the right side plate 22 is suppressed by using only the packaging material, and hence the strength necessary for the frame during transportation can be secured with a low environmental load and at low costs.

Only in the case where the packaging material P1 is interposed between the cassette and the cardboard box and where the cassette is supported by the packaging material P1, the rear-end regulation member engaging portions 3B and 3C respectively engage with the main body engaged portions 21B and 22B. Accordingly, in a normal operation of attaching and detaching the universal cassette with respect to the main body 2, which is performed without the use of the packaging material P1, the rear-end regulation member engaging portions 3B and 3C do not respectively engage with the main body engaged portions 21B and 22B. This can make the predetermined gap between the rear-end regulation member engaging portion 3B (3C) and the main body engaged portion 21B (22B) smaller, and this can even eliminate the need to provide the gap, as needed.

Also in the present embodiment, similarly to the first embodiment, the position of the back-end regulation member 3 at which the engaging portions 3B and 3C respectively engage with the engaged portions 21B and 22B may be selected as appropriate depending on the configuration of the main body (arrangement of the frame and the like). In the present embodiment, this position of the back-end regulation member 3 is set to a position coincident with an end portion of a standard-size sheet (for example, A4 sheet size). If this position of the back-end regulation member 3 is made coincident with a size frequently used by a user, the amount of work of the user at the initial use can be reduced.

Figure 10B:
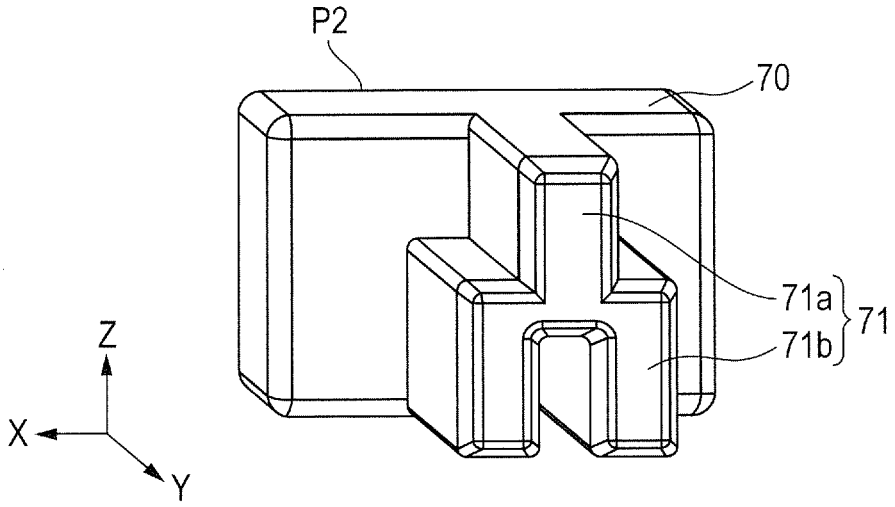
FIG. 10B shows a packaging material in the modified example of the second embodiment.

In the present embodiment, the position and posture of the universal cassette 1 is changed by using the packaging material P1, whereby whether or not the rear-end regulation member engaging portions 3B and 3C and the main body engaged portions 21B and 22B are in the engaged state is changed. As a modified example of the present embodiment, as illustrated in FIG. 10A, the position and posture of the universal cassette 1 are not changed, and a packaging material P2 is interposed between the rear-end regulation member engaging portion 3B (3C) and the main body engaged portion 21B (22B), whereby the engaged state thereof may be formed. That is, as illustrated in FIG. 10B, the packaging material P2 includes a rectangular flat plate part 70 and an interposition part 71 that are integrally formed using a foam material. The interposition part 71 includes a protruding portion 71*a* and a depressed portion 71*b*. The packaging material P2 is inserted from the back side to the front side (a Y-axis direction in the drawings) of the main body 2 such that the protruding portion 71*a* is inserted into the main body engaged portion 21B (22B) and that the depressed portion 71*b* is inserted into the rear-end regulation member engaging portion 3B (3C). In this state, as illustrated in FIG. 10A, the engaging portions 3B and 3C respectively engage with the engaged portions 21B and 22B with the intermediation of the packaging material P2, in the state where the universal cassette 1 is inserted in the main body. Also in this modified example, in a normal use state where the packaging material P2 is not inserted, the engaging portions 3B and 3C do not respectively engage with the engaged portions 21B and 22B even at the sheet feeding position at which the cassette 1 is attached to the main body 2.

The shape of the packaging material P2 and the insertion direction thereof into the main body 2 may be selected as appropriate, not limited to the above. In the present embodiment, the main body engaged portions 21B and 22B are components independent of the left side plate 21 and the right side plate 22, but may be directly formed in the left side plate 21 and the right side plate 22. In the present embodiment, the engaging portions of the universal cassette 1 are provided to the back-end regulation member 3, but, instead of the back-end regulation member 3, the engaging portions thereof may be provided as appropriate to another portion (such as the side-end regulation members 5A and 5B) of the universal cassette 1 according to the configuration of the main body 2.

Figure 8B:
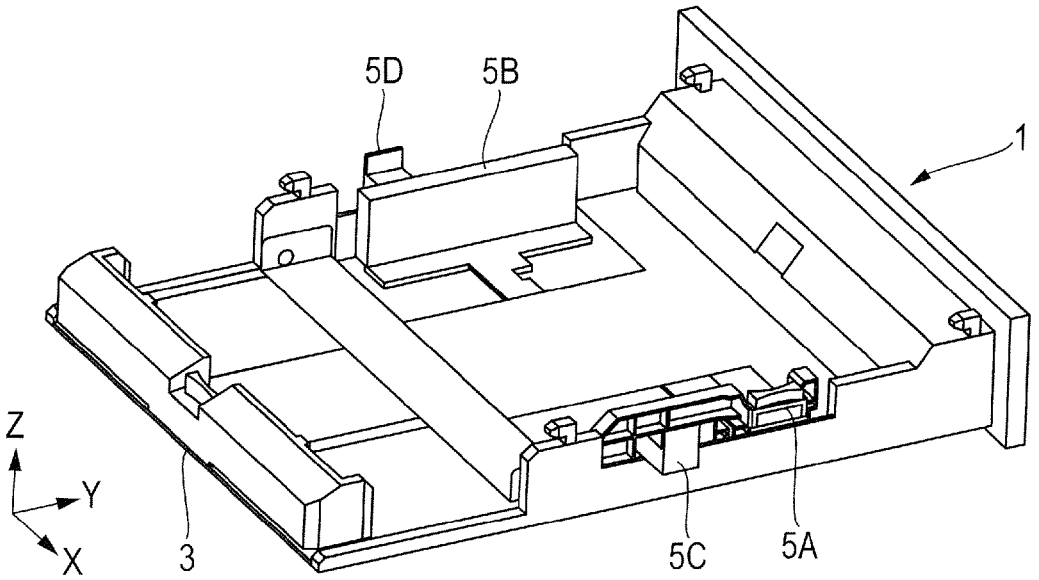
FIG. 8B shows a modified example of the first embodiment and a second embodiment.

FIG. 8B illustrates a modified example of the first embodiment and the second embodiment, in which engaging portions 5C and 5D of the cassette are respectively provided to the side-end regulation members 5A and 5B. Accordingly, the main body engaged portions are located so as to be respectively engageable with the engaging portions 5C and 5D in the state where the cassette 1 is attached to the main body 2 (frame unit 20). In this modified example, in the state where the pair of side-end regulation members 5A and 5B are the farthest from each other, the engaging portions 5C and 5D can respectively engage with the engaged portions provided to the left and right side plates 21 and 22.

In the first embodiment, the position of each engaged portion is a position that enables direct engagement thereof in the sheet feedable state where the cassette 1 is attached to the frame unit 20. In the second embodiment, in the case where the packaging material P1 is interposed between the lower surface of the cassette 1 and the cardboard box (see FIG. 9A and FIG. 9B), the position of each engaged portion is a position above each of the engaging portions 5C and 5D. In the second embodiment, in the case where the packaging material P2 is interposed between each engaging portion and each engaged portion (see FIG. 10A and FIG. 10B), the position of the engaged portion is a position at which the packaging material P2 is spaced apart from the engaging portion.

Accordingly, in this modified example, the engaging portions are respectively provided to the pair of side-end regulation members, and the pair of side-end regulation members including the engaging portions serves as strengthening members. The engaged portions are located so as to respectively engage with the engaging portions in the state where the pair of side-end regulation members are the farthest from each other and where the universal cassette is inserted in the frame.

Third Embodiment

A third embodiment of the present invention is described with reference to the drawings. In the present embodiment, configurations and operations of the same portions as those in the first embodiment and the second embodiment are omitted, and only portions different therefrom are described.

Figure 11A:
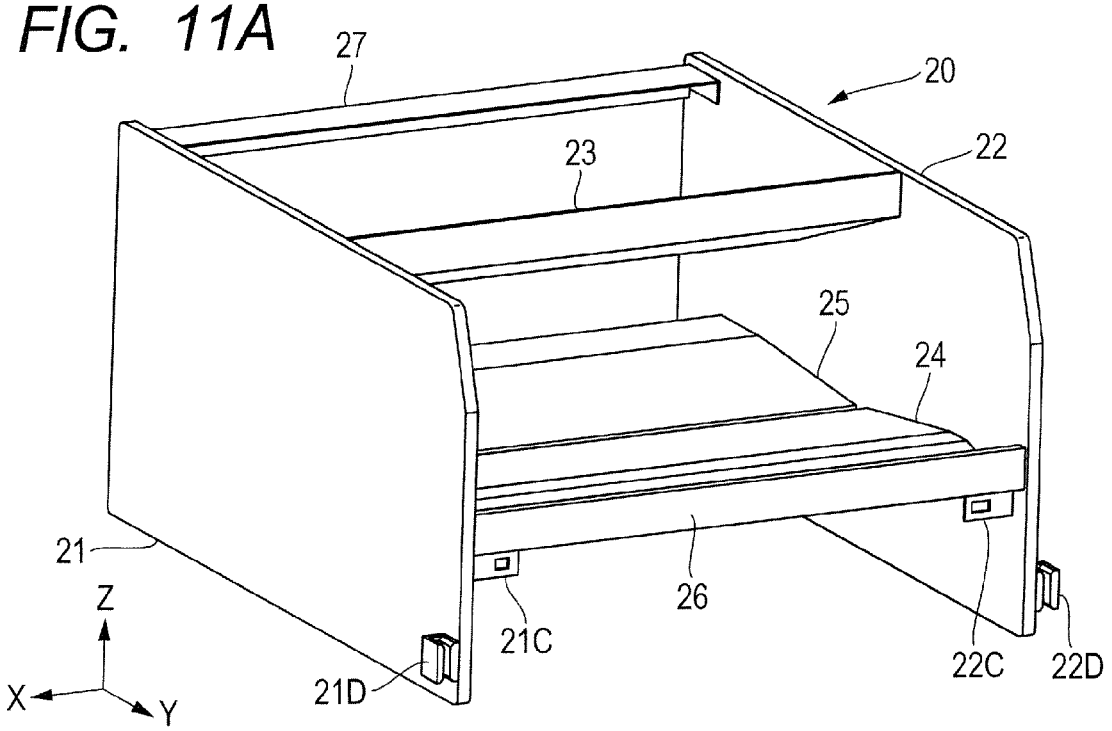
FIG. 11A shows a frame unit of an image forming apparatus according to the third embodiment.
Figure 11B:
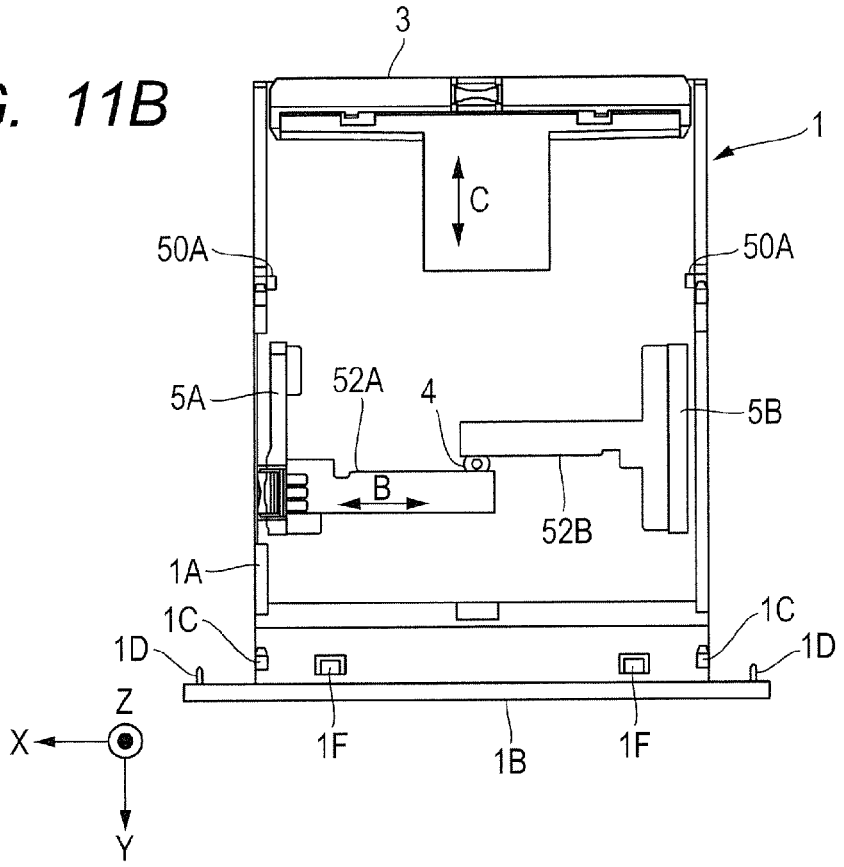
FIG. 11B is a top view of a universal cassette of the image forming apparatus according to the third embodiment.

FIG. 11A is a diagram illustrating the frame unit 20 of the main body 2 according to the present embodiment, and is a perspective view observed from the upper left front side of the main body 2. Compared with the first and second embodiments, main body engaged portions 21D and 22D are arranged on the near side (front side) of the main body 2. FIG. 11B is a diagram illustrating the universal cassette 1 according to the present embodiment. In the present embodiment, the rear-end regulation member engaging portions 3B and 3C as those in the first and second embodiments are not provided to both the ends of the back-end regulation member 3.

The universal cassette 1 includes a front-end wall portion 1B at the entrance-side end (front side) in the insertion direction into the main body 2, and the front-end wall portion 1B extends in the direction in which the left side plate 21 and the right side plate 22 face each other, that is, the direction along the sheet width direction. The front-end wall portion 1B is integrally formed along the width direction of the main body. Accordingly, the front-end wall portion forms a strengthening member having a predetermined stiffness in the compression/extension and bending directions thereof. Front-end wall engaging portions 1D and 1D protruding in the insertion direction are provided to both the end portions in the width direction of the front-end wall portion 1B. A tapered part is formed on the leading end side of each engaging portion 1D. The front-end wall portion 1B is coupled to the cassette main body 1A such that hooks 1F each have a predetermined slight play in the direction along the width of the main body. For ease of understanding, the middle plate 6 is not illustrated in FIG. 11B similarly to FIG.

3A and FIG. 3B, but the middle plate 6 is normally attached to the cassette main body 1A.

Figure 12:
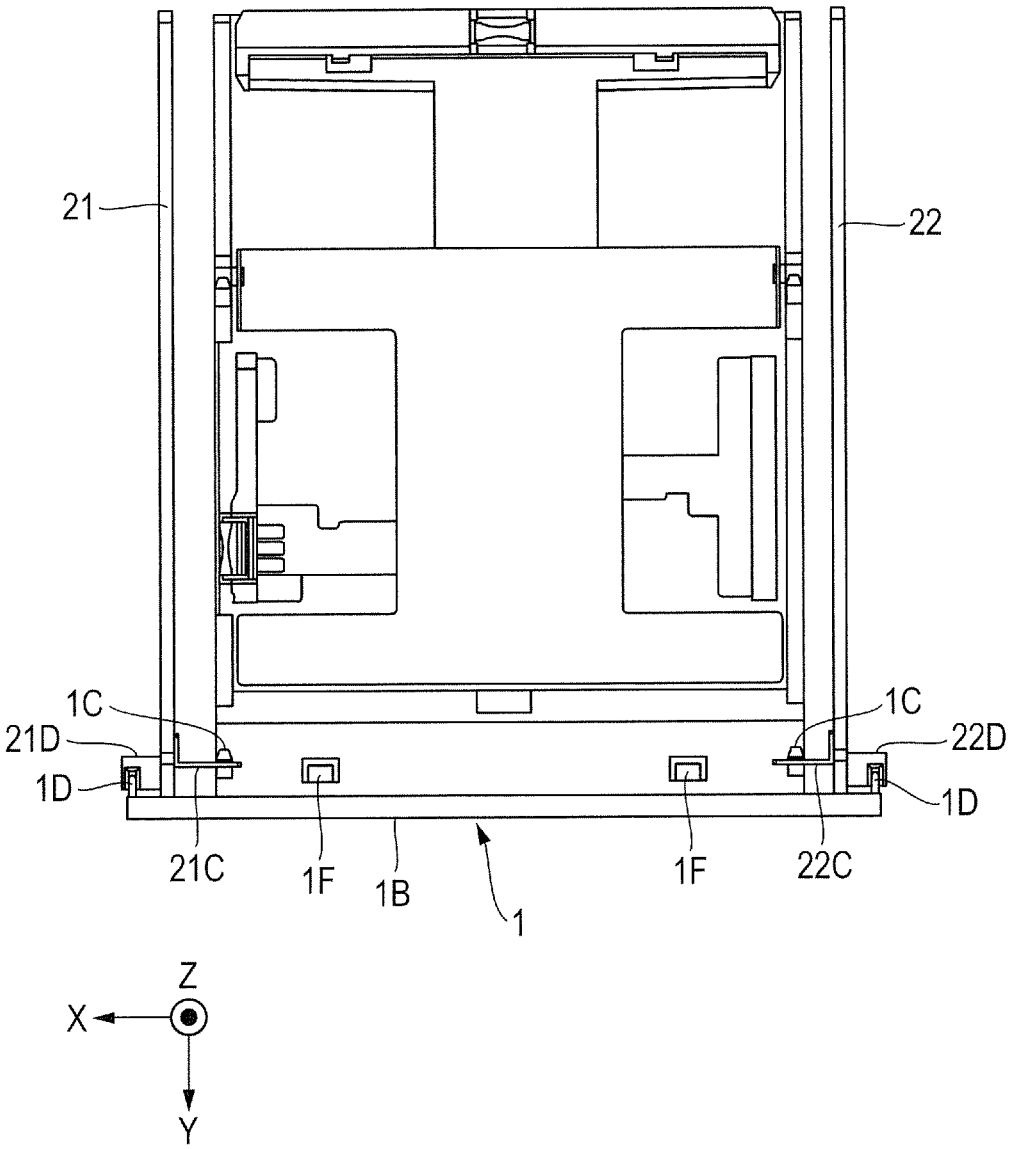
FIG. 12 shows an engaged state of front-end wall engaging portions and main body engaged portions of the image forming apparatus in the top view of the apparatus, according to the third embodiment.

FIG. 12 is a diagram illustrating states of cassette engaging portions and main body engaged portions according to the present embodiment when the main body 2 is observed from the upper side thereof. As illustrated in FIG. 12, in the state where the cassette main body 1A is inserted in the main body 2, the universal cassette 1 is positioned and fixed by connecting the positioning units 1C provided to the cassette main body 1A and the positioning and receiving portions 21C and 22C provided to the main body 2, similarly to the first embodiment. At the same time, the front-end wall engaging portions 1D and 1D provided to the front-end wall portion 1B respectively engage with the main body engaged portions 21D and 22D with a predetermined gap therebetween. For ease of understanding, the top plate 23, the registration unit supporting unit 24, the transfer roller supporting unit 25 and the stays 26 and 27 are not illustrated in FIG. 12, but the frame unit 20 actually includes these members.

As a result of the above-mentioned engagement, similarly to the first embodiment, even if external force in the plate surface direction is exerted on the lower portions (particularly, on the near side of the main body) of the left side plate 21 and the right side plate 22, deformation of the left side plate 21 and the right side plate 22 can be suppressed within the range of the above-mentioned gap, that is, the range of elastic deformation. At the same time, the cassette main body 1A and the front-end wall portion 1B are coupled to each other with the predetermined slight play. Hence, mutual interference does not occur between: the connection between the positioning units 1C provided to the cassette main body 1A and the positioning and receiving portions 21C and 22C provided to the main body 2; and the engagement between the front-end wall engaging portions 1D and the main body engaged portions 21D and 22D. Accordingly, the above-mentioned effects can be obtained without the occurrence of problems of an image failure and a sheet feeding failure due to an inappropriate position and posture of the universal cassette 1.

For transportation, the universal cassette 1 can be attached to the main body 2 such that the engaging portions 1D respectively engage with the engaged portions 21D and 22D. When the universal cassette 1 is inserted in the main body 2, the front-end wall portion 1B may be formed as a member inside of an exterior member of the main body 2, and the front-end wall portion itself may be the exterior member thereof. In the case where the front-end wall portion itself is the exterior member thereof, the number of components can be reduced, and hence costs of the main body can be reduced.

In the present embodiment, the sheet storing unit (universal cassette) includes the front-end wall portion that is arranged at the entrance-side end in the insertion direction into the frame and is integrally formed along the sheet width direction of the sheet storing unit. The engaging portions are respectively provided to both the end portions in the longitudinal direction of the front-end wall portion, and the front-end wall portion including the engaging portions serves as a strengthening member. The engaged portions are located so as to respectively engage with the engaging portions in the state where the sheet storing unit is inserted in the frame.

Fourth Embodiment

A fourth embodiment of the present invention is described with reference to the drawings. In the present embodiment, configurations and operations of the same portions as those in the third embodiment are omitted, and only portions different therefrom are described.

Figure 13A:
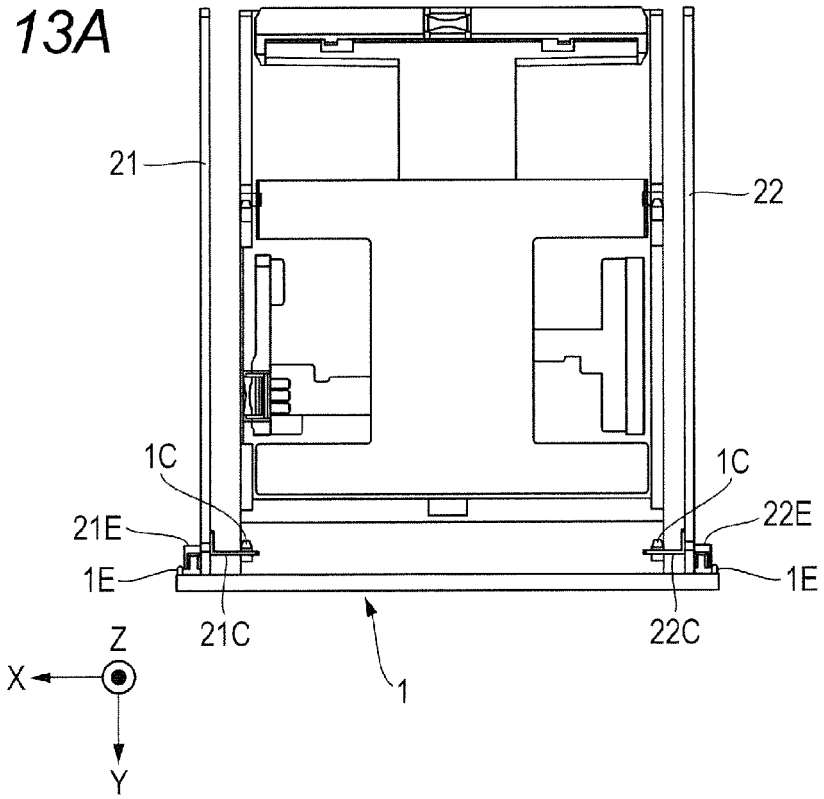
FIG. 13A shows a state where a packaging material is not used and where front-end wall engaging portions and main body engaged portions of an image forming apparatus do not engage with each other in a top view of the apparatus, according to the fourth embodiment.
Figure 13B:
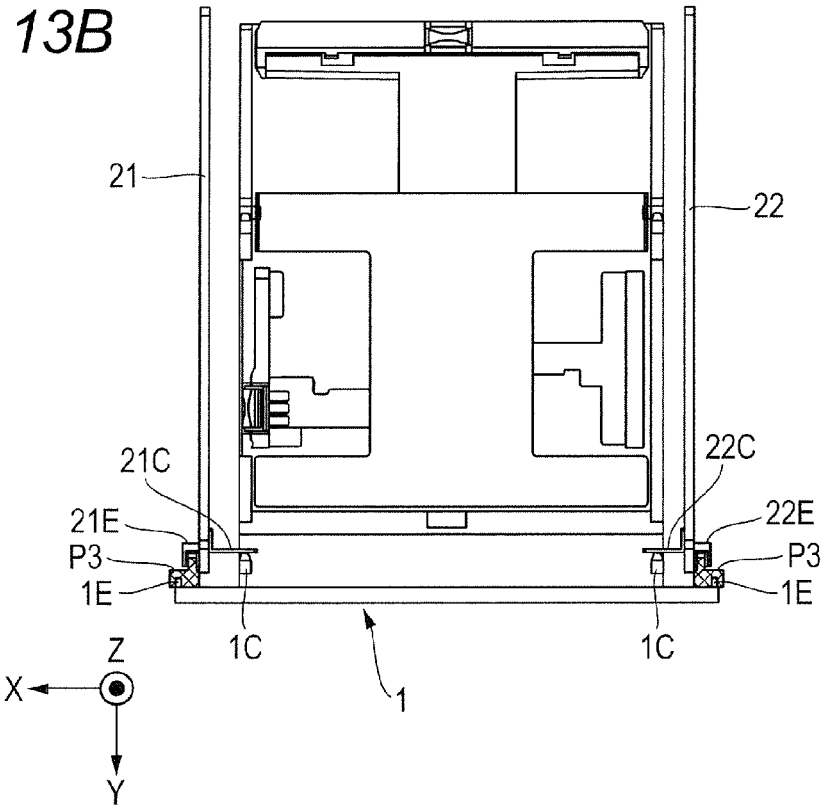
FIG. 13B shows a state where a packaging material is used and where the front-end wall engaging portions of the image forming apparatus, the main body engaged portions thereof and the packaging material engage with one another, according to the fourth embodiment.

FIG. 13A and FIG. 13B are diagrams each illustrating the state where the universal cassette 1 is inserted in the main body 2. FIG. 13A illustrates a normal use state such as a state during image formation, and FIG. 13B illustrates a packaged state such as a state during transportation, in which a packaging material P3 is interposed between the universal cassette 1 and the main body 2.

In the present embodiment, as illustrated in FIG. 13A, in the state where the universal cassette 1 is attached to the main body 2, front-end wall engaging portions 1E do not respectively engage with main body engaged portions 21E and 22E. For example, as an example of the present embodiment, the main body engaged portions 21E and 22E are each arranged on the inner side in the direction along the width of the main body, compared with the third embodiment. As other examples of the present embodiment, the engagement between the engaging portions and the engaged portions may be escaped in a different direction along the width of the main body, and may be escaped in the attachment and detachment direction of the universal cassette 1, and the size of each fitting part may be changed. That is, a convenient configuration may be adopted as appropriate. In this state, an operation of attaching and detaching the universal cassette 1 is not influenced.

Meanwhile, as illustrated in FIG. 13B, in the state where the packaging material P3 is interposed between the universal cassette 1 and the main body 2, the left packaging material P3 engages with the front-end wall engaging portion 1E and the main body engaged portion 21E. Similarly, the right packaging material P3 engages with the front-end wall engaging portion 1E and the main body engaged portion 22E. At this time, each engagement may have a predetermined slight gap, and may have no gap.

As a result of the above-mentioned engagement, similarly to the third embodiment, even if external force in the plate surface direction is exerted on the lower portions (particularly, on the near side of the main body) of the left side plate 21 and the right side plate 22, deformation of the left side plate 21 and the right side plate 22 can be suppressed within the range of the above-mentioned gap, that is, the range of elastic deformation. In addition, the size of the packaging material can be reduced compared with the case where the deformation of the lower portions of the left side plate 21 and the right side plate 22 is suppressed by using only the packaging material, and hence the strength necessary for the frame during transportation can be secured with a low environmental load and at low costs.

Only in the case of using the packaging material P3, the front-end wall engaging portions 1E respectively engage with the main body engaged portions 21E and 22E with the intermediation of the packaging material P3. In a normal operation of attaching and detaching the universal cassette 1 with respect to the main body 2, which is performed without the use of the packaging material P3, the front-end wall engaging portions 1E do not respectively engage with the main body engaged portions 21E and 22E. Accordingly, the front-end wall portion 1B can be coupled to the cassette main body 1A without the slight play therebetween in the direction along the width of the main body, which is provided in the third embodiment, and hence the configuration of the coupling portion therebetween can be simplified.

Similarly to the third embodiment, when the universal cassette 1 is inserted in the main body 2, the front-end wall portion 1B may be formed as a member inside of the exterior member of the main body 2, and the front-end wall portion itself may be the exterior member thereof. In the case where the front-end wall portion itself is the exterior member thereof, the number of components can be reduced, and hence costs of the main body can be reduced.

The present invention is not limited to the first to fourth embodiments. The engaging portions may be provided to any portions such as the exterior member of the sheet storing unit (cassette), and the above-mentioned embodiments may be combined as appropriate, whereby a plurality of the engaging portions may be provided to the back-end regulation member, the side-end regulation members, the front-end wall portion and other portions. In the third and fourth embodiments, the sheet storing unit is not limited to the universal cassette, and may be any sheet storing unit such as a cassette whose storable sheet size is fixed.

According to the present invention, the sheet storing unit is provided with a function as a reinforcing member for the frame, particularly, the bottom portion thereof. Accordingly, the size of the main body, particularly, the size thereof in the height direction is reduced while the stiffness of the frame is secured. For example, the strength necessary for the frame during transportation can be secured with a low environmental load and at low costs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-082513, filed Apr. 14, 2014, which is hereby incorporated by reference herein in its entirety.

What is claimed is:

1. A sheet stacking apparatus comprising:

a main body; and a stacking unit that is provided so as to be insertable and pullable with respect to the main body, wherein the main body includes:

a first frame provided on one side in a direction orthogonal to an insertion and a pull direction of the stacking unit;

a second frame provided on another side in the direction orthogonal to the insertion and the pull direction of the stacking unit; and a connection portion that connects the first frame and the second frame, wherein in a case where the stacking unit is inserted between the first frame and the second frame, the connection portion is positioned on an upper side of the stacking unit and not on a lower side of the stacking unit, and wherein the stacking unit includes:

a stacking portion on which a sheet is stacked; and a regulation member that is provided so as to be movable with respect to the stacking portion in the insertion and the pull direction of the stacking unit and regulates a position of an end portion of the sheet stacked on the stacking portion, wherein the regulation member prevents at least one of the first frame and the second frame from deforming toward the stacking unit in the direction orthogonal to the insertion and the pull direction of the stacking unit.

2. The apparatus according to claim 1, wherein the regulation member includes:

a first end portion on one side in the direction orthogonal to the insertion and pull direction;

a second end portion on another side in the direction orthogonal to the insertion and pull direction; and an extension part between the first end portion and the second end portion.

3. The apparatus according to claim 1, wherein the regulation member regulates deformation of the first frame toward the second frame in the direction orthogonal to the insertion and pull direction of the stacking unit, because of engagement between a first engaging portion provided to the stacking unit and a first engaged portion provided to the first frame.

4. The apparatus according to claim 3, wherein the regulation member regulates deformation of the second frame toward the first frame in the direction orthogonal to the insertion and pull direction of the stacking unit, because of engagement between a second engaging portion provided to the stacking unit and a second engaged portion provided to the second frame.

5. The apparatus according to claim 4, wherein the stacking unit includes a supporting unit that supports the stacking portion and the regulation member, wherein the first engaged member and the second engaged member are provided on the supporting unit.

6. The apparatus according to claim 1, wherein the regulation member regulates a position of sheet ends stacked on the stacking unit, the sheet ends defined in the insertion and pull direction of the stacking unit.

7. An image forming apparatus comprising:

a sheet storing unit that stores a sheet;

an image forming unit that forms an image on the sheet fed from the sheet storing unit;

a frame unit that supports the image forming unit, the sheet storing unit being insertably and pullably attached to the frame unit; and a packaging material that supports the sheet storing unit, wherein the frame unit includes two frame members that are arranged parallel to each other with a predetermined distance therebetween and are connected and fixed to each other, wherein the two frame members respectively include engaged portions, wherein the sheet storing unit includes engaging portions that are respectively engageable with the engaged portions in a state where the sheet storing unit is inserted in the frame unit, wherein in a state where the engaging portions respectively engage with the engaged portions, the engaging portions that respectively engage with the engaged portions and a portion between the two engaging portions of the sheet storing unit serve as strengthening members to regulate deformation of the two frame members by at least a predetermined amount, wherein the engaged portions are located so as not to respectively engage with the engaging portions in a state where the packaging material is not used and where the sheet storing unit is attached to the frame unit such that the sheet is feedable from the sheet storing unit toward the image forming unit, and the engaged portions are located so as to respectively engage with the engaging portions in a state where the sheet storing unit is inserted in the frame unit while being supported by the packaging material.

8. The apparatus according to claim 7, wherein the frame unit has an opened lower portion, wherein the sheet storing unit is insertably and pullably attached to the lower portion of the frame unit from a front side thereof, and wherein the two frame members are left and right side plates.

9. The apparatus according to claim 7, wherein the engaged portions are located so as to respectively engage with the engaging portions in a state where the sheet storing unit is attached such that the sheet is feedable from the sheet storing unit toward the image forming unit.

10. The apparatus according to claim 7, wherein each engaging portion engages with each engaged portion with a predetermined gap therebetween.

11. The apparatus according to claim 7, wherein a tapered part that guides each engaging portion and each engaged portion into an engaged state is formed in at least one of the engaging portion and the engaged portion.

12. The apparatus according to claim 7, wherein the sheet storing unit is a universal cassette including:

a cassette main body in which sheets having various sizes are storable;

a back-end regulation member that regulates a back-end position of each sheet; and a pair of side-end regulation members that respectively regulate side-end positions of each sheet.

13. The apparatus according to claim 12, wherein the engaging portions are respectively provided in both end portions in a longitudinal direction of the back-end regulation member, the back-end regulation member including the engaging portions serves as the strengthening member, and a movement direction of the back-end regulation member is an insertion and pull direction of the universal cassette with respect to the frame unit.

14. The apparatus according to claim 13, wherein the engaged portions are located so as to respectively engage with the engaging portions in a state where the universal cassette is inserted in the frame unit, at a position at which the back-end regulation member regulates a back end of a sheet that has a predetermined size and is stored in the cassette main body.

15. The apparatus according to claim 14, wherein the engaging portions each include a plate-like projection that extends in the insertion and pull direction of the universal cassette along a plane orthogonal to a width direction of the cassette main body, and the engaged portions each include a groove including: side parts that are opposedly arranged with a predetermined distance therebetween so as to sandwich the plate-like projection; and a bottom portion that connects the side parts.

16. The apparatus according to claim 13, wherein the engaging portions are respectively provided to the pair of side-end regulation members, the pair of side-end regulation members including the engaging portions serve as the strengthening members, and the engaged portions are located so as to respectively engage with the engaging portions in a state where the pair of side-end regulation members are the farthest from each other and where the universal cassette is inserted in the frame unit.

17. The apparatus according to claim 7, wherein the sheet storing unit includes a front-end wall portion that is arranged at an entrance-side end in an insertion direction into the frame unit and is integrally formed along a sheet width direction of the sheet storing unit, the engaging portions are respectively provided in both end portions in a longitudinal direction of the front-end wall portion, the front-end wall portion including the engaging portions serves as the strengthening member, and the engaged portions are located so as to respectively engage with the engaging portions in the state where the sheet storing unit is inserted in the frame unit.

18. The apparatus according to claim 7, wherein the sheet storing unit includes a pair of positioning units, and the two frame members respectively include positioning and receiving portions that engage with the positioning units in a state where the sheet storing unit is attached to the frame unit.

19. An image forming apparatus comprising:

a sheet storing unit that stores a sheet;

an image forming unit that forms an image on the sheet fed from the sheet storing unit;

a frame unit that supports the image forming unit, the sheet storing unit being insertably and pullably attached to the frame unit; and a packaging material that is interposed between each engaging portion and each engaged portion, wherein the engaged portions are located so as not to respectively engage with the engaging portions in a state where the packaging material is not used and where the sheet storing unit is attached to the frame unit such that the sheet is feedable from the sheet storing unit toward the image forming unit, and wherein the engaged portions are located so as to respectively engage with the engaging portions in a state where the packaging material is interposed between each engaging portion and each engaged portion and where the sheet storing unit is inserted in the frame unit, wherein the frame unit includes two frame members that are arranged parallel to each other with a predetermined distance therebetween and are connected and fixed to each other, wherein the two frame members respectively include engaged portions, and wherein the sheet storing unit includes engaging portions that are respectively engageable with the engaged portions in a state where the sheet storing unit is inserted in the frame unit.

* * * * *